US006305078B1

(12) United States Patent
Shiga et al.

(10) Patent No.: US 6,305,078 B1
(45) Date of Patent: Oct. 23, 2001

(54) METHOD OF MAKING A TURBINE BLADE

(75) Inventors: Masao Shiga, Hitachiohta; Takeshi Onoda, Hitachi; Shigeyoshi Nakamura, Hitachinaka; Yutaka Fukui, Hitachi, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/605,674

(22) Filed: Jun. 28, 2000

Related U.S. Application Data

(62) Division of application No. 09/125,206, filed as application No. PCT/JP96/00336 on Feb. 16, 1996, now Pat. No. 6,129,514.

(51) Int. Cl.[7] ..... B23P 15/00

(52) U.S. Cl. ..... 29/889.7; 29/889

(58) Field of Search ..... 29/889.7, 889; 148/547, 548, 559, 326, 335; 416/241 R; 415/100, 101, 103, 199.4, 199.5, 200, 216.1

(56) References Cited

U.S. PATENT DOCUMENTS

| | | | | |
|---|---|---|---|---|
| 3,650,845 | * | 3/1972 | Oda et al. | 148/2 |
| 3,819,338 | * | 6/1974 | Bungardt et al. | 29/889.7 |
| 3,897,535 | * | 7/1975 | Lapac et al. . | |
| 3,939,653 | * | 2/1976 | Schirmer | 60/39.65 |
| 3,986,347 | * | 10/1976 | Schirmer | 60/39.02 |
| 4,012,902 | * | 3/1977 | Schirmer | 60/39.02 |
| 4,134,758 | * | 1/1979 | Nagai et al. | 148/133 |
| 4,414,024 | * | 11/1983 | Siga et al. | 148/37 |
| 4,477,280 | * | 10/1984 | Shiga et al. | 75/124 |
| 4,486,240 | * | 12/1984 | Sciaky | 148/4 |
| 4,778,345 | * | 10/1988 | Ito et al. | 416/241 B |
| 5,624,235 | | 4/1997 | Siga et al. . | |
| 5,733,391 | * | 3/1998 | Bass | 148/644 |
| 5,749,228 | | 5/1998 | Shiga et al. . | |
| 5,961,284 | | 10/1999 | Kuriyama et al. . | |
| 6,127,044 | * | 10/2000 | Yamamoto et al. | 428/603 |

FOREIGN PATENT DOCUMENTS

| | | |
|---|---|---|
| 2142924 | 8/1995 | (CA) . |
| 384181 | 8/1990 | (EP) . |
| 59-116360 | 7/1984 | (JP) . |
| 61-133365 | 6/1986 | (JP) . |
| 63-171856 | 7/1988 | (JP) . |
| 4-120246 | 4/1992 | (JP) . |
| 5-113106 | 5/1993 | (JP) . |
| 7-233704 | 9/1995 | (JP) . |

* cited by examiner

*Primary Examiner*—I Cuda Rosenbaum
(74) *Attorney, Agent, or Firm*—Mattingly, Stanger & Malur, P.C.

(57) ABSTRACT

A compact steam turbine power-generation plant has a compact steam turbine that operates at a high temperature in a range of 600 to 660° C. Ferrite based heat resisting steels provide for thermal efficiency. The main steam temperature and the reheated steam temperature can be set in a range of 600 to 660° C. by making the main parts exposed to the high temperature atmosphere, such as the rotor shaft, from ferrite based forged steels and cast steels and by making a final stage blade of a low pressure turbine from a martensite steel. The final stage blade is made from a ferrite based forged steel having a tensile strength of 120 kgf/mm$^2$ or more; the rotor shaft is made from a ferrite based forged steel having a $10^5$ h creep rupture strength of 11 kgf/mm$^2$ or more; and the inner casing is made from a ferrite based cast steel having a $10^5$ h creep rupture strength of 10 kgf/mm$^2$ or more.

1 Claim, 15 Drawing Sheets

METHOD OF MAKING A TURBINE BLADE

This is a divisional application of U.S. Ser. No. 09/125,206, filed Aug. 13, 1998, now U.S. Pat. No. 6,129,514 which is a 371 of PCT/JP/00336, filed Feb. 16, 1996.

TECHNICAL FIELD

The present invention relates to a compact steam turbine and particularly to a high temperature steam turbine in which the 12% Cr based steel is used for a final stage rotating blade of a low pressure steam turbine.

BACKGROUND ART

The rotating blade for a steam turbine is made from a 12Cr—Mo—Ni—V—N steel at the present time. In recent years, there is a desire to improve the thermal efficiency of the gas turbine from the viewpoint of energy saving and to make the equipment of the gas turbine to make compact from the viewpoint of space savings.

To improve the thermal efficiency of a gas turbine and to make the equipment there of more compact, it is effective to make the blades of the steam turbine longer, and for this purpose, there has been a tendency to make the length of the final stage blades of the low pressure steam turbine longer every year. With such a tendency, the service condition for the blades of a steam turbine becomes strict, and as a result the 12 Cr—Mo—Ni—V—N steel is no longer sufficient in strength under the above service conditions, and therefore, it is expected that a new material will be developed having a higher strength. The strength of the material for the blades of the steam turbine, is determined by its tensile strength which is a basic mechanical characteristic.

The material for the blades of a steam turbine is also required to exhibit a high toughness in addition to a high strength for ensuring safety against breakage.

As a structural material having a tensile strength higher than that of the conventional 12 Cr—Mo—Ni—V—N steel (martensite based steel), there are generally known a Ni based alloy and a Co based alloy; however, such a materials are undesirable as blade materials because of their poor working ability at hot temperatures, poor, machinability, and periodic damping characteristic.

A disk material for a gas turbine is known, for example, from Japanese Patent Laid-open Nos. Sho 63-171856 and Hei 4-120246.

In the conventional steam turbine, the maximum s team temperature has been set at 566° C. and the maximum steam pressure has been set at 246 atg.

However, from the viewpoint of exhaustion of fossil fuel such as miner al oil or coal, energy saving, and prevention of environmental pollution, it is desired to increase the efficiency of the thermal power-generation plant, and to increase the efficiency of power-generation, it is most effective to increase the steam temperature of the steam turbine. A suitable material for such a high efficient ultra-high temperature steam turbine is known from Japanese Patent Laid-open No. Hei 7-233704.

The present invention has been made to cope with the recent trend to make the blades of a low pressure steam turbine longer. A suitable material for the rotating blades for a steam turbine is not disclosed in Japanese Patent Laid-open Nos. Sho 63-171856 and Hei 4-120246 at all.

Japanese Patent Laid-open No. Hei 7-233704 discloses a rotor material, a casing material, and the like; however, as described above, the document does not describe a 12% Cr based martensite steel for a final stage rotating blade for a high pressure side turbine-intermediate pressure side turbine integral type steam turbine and a low pressure steam turbine which are operated at high temperatures .

An object of the present invention is to provide a steam turbine operable at a high temperature in a range of 600 to 660° C. by use of ferrite based heat resisting steels, to thereby enhance the thermal efficiency, and a steam turbine power-generation plant using the steam turbine.

Another object of the present invention is to provide a steam turbine operable at each operating temperature in a range of 600 to 660° C. with its basic structure being substantially not changed, and a steam turbine power-generation plant using the steam turbine.

DISCLOSURE OF INVENTION

The present invention provides a steam turbine power-generation plant including a combination of a high pressure turbine, an intermediate pressure turbine and two low pressure turbines, a combination of a high pressure turbine and a low pressure turbine connected to each other and an intermediate pressure turbine and a low pressure turbine connected to each other, or a combination of a high pressure side turbine-intermediate pressure side turbine integral steam turbine and one low pressure turbine or two low pressure turbines connected in tandem with each other, in which the temperature of a steam inlet to a first stage rotating blade of each of the high pressure turbine and the intermediate pressure turbine or the high pressure/intermediate pressure turbine is in a range of 600 to 660° C. (preferably, 600 to 620° C., 620 to 630° C., 630 to 640° C.) and the temperature of a steam inlet to a first stage rotating blade of the low pressure turbine is in a range of 350 to 400° C., characterized in that a rotor shaft, rotating blades, stationary blades, and an inner casing, exposed to the temperature atmosphere of the steam inlet, of each of the high pressure turbine and the intermediate pressure turbine or the high pressure/intermediate pressure turbine are made from a high strength martensite steel containing Cr in an amount of 8 to 13 wt %; and a final stage rotating blade of the low pressure turbine is specified such that a value of [the length of a blade (inch)×the number of revolution (rpm)] is 125,000 or more.

The present invention provides a steam turbine, particularly, a high pressure side turbine-intermediate pressure side turbine integral type steam turbine in which steam discharged from a high pressure side turbine is heated at a temperature equal to or higher than an inlet temperature on the high pressure side and fed in an intermediate pressure turbine, the steam turbine including a rotor shaft, rotating blades planted in the rotor shaft, stationary blades for guiding flow of steam to the rotating blades, and an inner casing for holding the stationary blades, in which the temperature of the steam flowing to a first stage one of the rotating blades is in a range of 600 to 660° C. and the pressure is 250 kgf/cm$^2$ or more (preferably 246 to 316 kgf/cm$^2$) or 170 to 200 kgf/cm$^2$, characterized in that the rotor shaft or the rotor shaft, at least a first stage one of the rotating blades, and a first stage one of the stationary blades are made from a high strength martensite steel containing Cr in an amount of 9.5 to 13 wt % (preferably, 10.5 to 11.5 wt %) and having a full temper martensite structure, the martensite steel being specified such that a $10^5$ h creep rupture strength thereof at a temperature corresponding to each steam temperature (preferably, 610° C., 625° C., 640° C., 650° C., 660° C.) is in a range of 10 kgf/mm$^2$ or more (preferably, 17 kgf/mm$^2$ or more); and the inner casing is made from a martensite cast steel containing Cr in an amount of 8 to 9.5 wt %, the martensite steel being specified such that the $10^5$ h creep rupture strength at the temperature corresponding to the steam temperature is in a range of 10 kgf/mm$^2$ or more (preferably, 10.5 kgf/mm2 or more).

In the high pressure turbine and the intermediate pressure turbine or the high pressure side turbine intermediate pressure side turbine integral type steam turbine, preferably, the rotor shaft, at least a first stage one of the rotating blades, and a first stage one of the stationary blades, which are preferably used at a steam temperature of 620 to 640° C., are made from a high strength martensite steel containing 0.05 to 0.20 wt % of C, 0.15 wt % or less of Si, 0.05 to 1.5 wt % of Mn, 9.5 to 13 wt % of Cr, 0.05 to 1.0 wt % of Ni, 0.05 to 0.35 wt % of V, 0.01 to 0.20 wt % of Nb, 0.01 to 0.06 wt % of N, 0.05 to 0.5 wt % of Mo, 1.0 to 4.0 wt % of W, 2 to 10 wt % of Co, and 0.0005 to 0.03 wt % of B, the balance being 78 wt % or more of Fe; and the rotor shaft, at least a first stage one of the rotating blades, and a first stage one of the stationary blades, which are preferably used at a steam temperature of 600 to less than 620° C., are made from a high strength martensite steel containing 0.1 to 0.25 wt % of C, 0.6 wt % or less of Si, 1.5 wt % or less of Mn, 8.5 to 13 wt % of Cr, 0.05 to 1.0 wt % of Ni, 0.05 to 0.5 wt % of V, 0.10 to 0.65 wt % of W and 0.1 wt % or less of Al, the balance being 80 wt % or more of Fe. Further, the above inner casing is preferably made from a high strength martensite steel containing 0.06 to 0.16 wt % of C, 0.5 wt % or less of Si, 1 wt % or less of Mn, 0.2 to 1.0 wt % of Ni, 8 to 12 wt % of Cr, 0.05 to 0.35 wt % of V, 0.01 to 0.15 wt % of Nb, 0.01 to 0.8 wt % of N, 1 wt % or less of Mo, 1 to 4 wt % of W, and 0.0005 to 0.003 wt % of B, the balance being 85 wt % or more of Fe.

In the high pressure steam turbine according to the present invention, preferably, nine stages or more, preferably, ten stages or more of the rotating blades are provided and the first stage one of the rotating blades is of a double-flow type; and the rotor shaft is made from a high strength martensite steel containing Cr in an amount of 9 to 13 wt %, the rotor shaft being specified such that a distance (L) between centers of bearings provided for the rotor shaft is 5000 mm or more (preferably, 5100 to 6500 mm), the minimum diameter (D) of portions, of the rotor shaft, corresponding to the stationary blades is 660 mm or more (preferably, 680 to 740 mm), and the ratio (L/D) is in a range of 6.8 to 9.9 (preferably, 7.9 to 8.7).

In the intermediate pressure steam turbine according to the present invention, preferably, the rotating blades have a double-flow structure in which two sets, each being composed of six stages or more of the rotating blades, are symmetrically disposed right and left and a first stage one of the rotating blade is planted at the central portion of the rotor shaft; and the rotor shaft is made from a high strength martensite steel containing Cr in an amount of 9 to 13 wt %, the rotor shaft being specified such that a distance (L) between centers of bearings provided for the rotor shaft is 5000 mm or more (preferably, 5100 to 6500 mm), the minimum diameter (D) of portions, of the rotor shaft, corresponding to the stationary blades is 630 mm or more (preferably, 650 to 710 mm), and the ratio (L/D) is in a range of 7.0 to 9.2 (preferably, 7.8 to 8.3).

The present invention provides a low pressure steam turbine separately having a high pressure turbine and an intermediate pressure turbine, characterized in that the rotating blades has a double-flow structure in which two sets, each being composed of six stages or more of the rotating blades, are symmetrically disposed right and left, and a first stage one of the rotating blades is planted at a central portion of the rotor shaft; the rotor shaft is made from a Ni—Cr—Mo—V based low alloy steel containing Ni in an amount of 3.25 to 4.25 wt %, the rotor shaft being specified such that a distance (L) between centers of bearings provided for the rotor shaft is 6500 mm or more (preferably, 6600 to 7100 mm), the minimum diameter (D) of portions, of the rotor shaft, corresponding to the stationary blades is 750 mm or more (preferably, 760 to 900 mm), and the ratio (L/D) is in a range of 7.8 to 10.2 (preferably, 8.0 to 8.6); and a final stage one of the rotating blades is made from a high strength martensite steel, the final stage rotating blade being specified such that a value of [the length of a blade (inch)×the number of revolution (rpm)] is 125,000 or more.

The present invention provides a steam turbine power-generation plant including a combination of a high pressure turbine, an intermediate pressure turbine and two low pressure turbines, a combination of a high pressure turbine and a low pressure turbine connected to each other and an intermediate pressure turbine and a low pressure turbine connected to each other, or a combination of a high pressure side turbine-intermediate pressure side turbine integral steam turbine and one low pressure turbine or two low pressure turbines connected in tandem with each other, in which the temperature of a steam inlet to a first stage rotating blade of each of the high pressure turbine and the intermediate pressure turbine or the high pressure/intermediate pressure turbine is in a range of 600 to 660° C. and the temperature of a steam inlet to a first stage rotating blade of the low pressure turbine is in a range of 350 to 400° C.; the metal temperature of each of the first stage rotating blade planted portion and the first stage rotating blade of the rotor shaft of the high pressure turbine is not allowed to be lower, 40° C. or more, than the temperature of the steam inlet to the first stage rotating blade of the high pressure turbine (preferably lower 20–35° C. than the steam temperature); and the metal temperature of each of the first stage rotating blade planted portion and the first stage rotating blade of the rotor shaft of the intermediate pressure turbine is not allowed to be lower, 75° C. or more, than the temperature of the steam inlet to the first stage rotating blade of the intermediate pressure turbine (preferably, lower 50–70° C. than the steam temperature), characterized in that the rotor shaft and at least the first stage rotating blade of each of the high pressure turbine and the intermediate pressure turbine are made from a martensite steel containing Cr in an amount of 9.5 to 13 wt %; and a final stage one of the rotating blades is made from a high strength martensite steel, the final stage rotating blade being specified such that a value of [the length of a blade (inch)×the number of revolution (rpm)] is 125,000 or more.

The present invention provides a coal burning thermal power-generation plant including a coal burning boiler, a steam turbine driven by steam produced by the boiler, a single or double generators driven by the steam turbine to generate a power of 1000 MW or more, characterized in that the steam turbine has a combination of a high pressure turbine, an intermediate pressure turbine and two low pressure turbines, a combination of a high pressure turbine and a low pressure turbine connected to each other and an intermediate pressure turbine and a low pressure turbine connected to each other, or a combination of a high pressure side turbine-intermediate pressure side turbine integral steam turbine and one low pressure turbine or two low pressure turbines connected in tandem with each other; the temperature of a steam inlet to a first stage rotating blade of each of the high pressure turbine and the intermediate pressure turbine or the high pressure/intermediate pressure turbine is in a range of 600 to 660° C. and the temperature of a steam inlet to a first stage rotating blade of the low pressure turbine is in a range of 350 to 400° C.; steam heated at a temperature higher 3° C. or more (preferably, 3 to 10° C., more preferably, 3 to 7° C.) than the temperature of the steam inlet to the first stage rotating blade of the high pressure turbine by a superheater of the boiler is allowed to flow to the first stage rotating blade of the high pressure turbine; the steam discharged from the high pressure turbine is heated at a temperature higher 2° C. or more (preferably, 2 to 10° C., more preferably, 2 to 5° C.) than the temperature of the steam inlet of the first stage rotating blade of the intermediate pressure blade by a re-heater of the boiler and is allowed to flow to the first stage rotating blade of the intermediate pressure turbine; and the steam discharged from the intermediate pressure turbine is heated at a temperature higher 3° C. or more (preferably, 3 to 10° C., more preferably, 3 to 6° C.) than the temperature of the steam inlet to the first stage rotating blade of the low pressure turbine by an economizer of the boiler and is allowed to flow to the first stage rotating blade of the low pressure turbine; and a final stage one of the rotating blades of the low pressure turbine is made from a high strength martensite steel, the final stage rotating blade being specified such that a value of [the length of a blade (inch)×the number of revolution (rpm)] is 125,000 or more.

In the above low pressure steam turbine having the high pressure turbine and the intermediate pressure turbine or the high pressure/intermediate pressure integral turbine, preferably, the temperature of a steam inlet to a first stage one of the rotating blades is in a range of 350 to 400° C. (preferably, 360 to 380° C.); and the rotor shaft is made from a low alloy steel containing 0.2 to 0.3 wt % of C, 0.05 wt % or less of Si, 0.1 wt % or less of Mn, 3.25 to 4.25 wt % of Ni, 1.25 to 2.25 wt % of Cr, 0.07 to 0.20 wt % of Mo, and 0.07 to 0.2 wt % of V, the balance being 92.5 wt % or more of Fe.

In the above high pressure steam turbine, preferably, seven stages or more (preferably, nine to twelve stages) of the rotating blades are provided; the length of a blade portion of each of the rotating blades arranged from the upstream side to the downstream side of the steam flow is in a range of 25 to 180 mm; the diameter of a rotating blade planted portion of the rotor shaft is larger than the diameter of a portion, of the rotor shaft, corresponding to the stationary shaft; the axial root width of the rotating blade planted portion becomes stepwise larger from the upstream side to the downstream side in three steps or more (preferably, in four to seven steps); the ratio of the axial root width of the rotating blade planted portion to the length of the blade portion is in a range of 0.2 to 1.6 (preferably, 0.30 to 1.30, more preferably, 0.65 to 0.95) and becomes smaller from the upstream side to the downstream side.

In the above high pressure steam turbine, preferably, seven stages or more (preferably, nine stages or more) of the rotating blades are provided; the length of a blade portion of each of the rotating blades arranged from the upstream side to the downstream side of the steam flow is in a range of 25 to 180 mm; and the ratio between the lengths of the blade portions of the adjacent ones of the rotating blades is in a range of 2.3 or less and becomes gradually larger to the downstream side, and the length of the blade portion becomes larger from the upstream side to the downstream side.

In the above high pressure steam turbine, preferably, seven stages or more (preferably, nine stages or more) of the rotating blades are provided; the length of a blade portion of each of the rotating blades arranged from the upstream side to the downstream side of the steam flow is in a range of 25 to 180 mm; and the axial width of a portion, of the rotor shaft, corresponding to the stationary blade becomes stepwise smaller from the upstream side to the downstream side in two steps or more (preferably, in two to four steps), and the ratio of the above axial width to the length of the blade portion of the rotating blade on the downstream side is in a range of 4.5 or less and becomes stepwise smaller to the downstream side.

In the above intermediate pressure steam turbine, preferably, the rotating blades have a double-flow structure in which two steps, each being composed of six stages or more (preferably, six to nine stages) of the rotating blades, are symmetrically disposed right and left; the length of a blade portion of each of the rotating blades arranged from the upstream side to the downstream side of the steam flow is in a range of 60 to 300 mm; the diameter of a rotating blade planted portion of the rotor shaft is larger than the diameter of a portion, of the rotor shaft, corresponding to the stationary shaft; the axial root width of the rotating blade planted portion becomes stepwise larger from the upstream side to the downstream side in two steps or more (preferably, in two to six steps); the ratio of the axial root width of the rotating blade planted portion to the length of the blade portion is in a range of 0.35 to 0.80 (preferably, 0.5 to 0.7) and becomes smaller from the upstream side to the downstream side.

In the above intermediate pressure steam turbine, preferably, the rotating blades have a double-flow structure in which two steps, each being composed of six stages or more of the rotating blades, are symmetrically disposed right and left; the length of a blade portion of each of the rotating blades arranged from the upstream side to the downstream side of the steam flow is in a range of 60 to 300 mm; and the length of the blade portion becomes larger from the upstream side to the downstream side, and the ratio between the lengths of the blade portions of the adjacent ones of the rotating blades is in a range of 1.3 or less (preferably, 1.1 to 1.2) and becomes gradually larger to the downstream side.

In the above intermediate pressure steam turbine, preferably, the rotating blades have a double-flow structure in which two steps, each being composed of six stages or more of the rotating blades, are symmetrically disposed right and left; the length of a blade portion of each of the rotating blades arranged from the upstream side to the downstream side of the steam flow is in a range of 60 to 300 mm; and the axial width of the portion, of the rotor shaft, corresponding to the stationary blade becomes stepwise smaller from the upstream side to the downstream side in two steps or more (preferably, in three to six steps), and the ratio of the above axial width to the length of the blade portion of the rotating blade on the downstream side is in a range of 0.80 to 2.50 (preferably, 1.0 to 2.0) and becomes stepwise smaller to the downstream side.

In the above low pressure steam turbine in the power-generation plant in which the high pressure turbine and the intermediate pressure turbine are separately provided, preferably, the rotating blades have a double-flow structure in which two steps, each being composed of six stages or more (preferably, eight to ten stages) of the rotating blades, are symmetrically disposed right and left; the length of a blade portion of each of the rotating blades arranged from the upstream side to the downstream side of the steam flow is in a range of 80 to 1300 mm; the diameter of a rotating blade planted portion of the rotor shaft is larger than the diameter of a portion, of the rotor shaft, corresponding to the stationary shaft; the axial root width of the rotating blade planted portion becomes stepwise larger from the upstream side to the downstream side in three steps or more (preferably, in four to seven steps); and the ratio of the axial root width of the rotating blade planted portion to the length of the blade portion is in a range of 0.2 to 0.7 (preferably, 0.3 to 0.55) and becomes smaller from the upstream side to the downstream side.

In the above low pressure steam turbine in the power-generation plant in which the high pressure turbine and the intermediate pressure turbine are separately provided, preferably, the rotating blades have a double-flow structure in which two sets, each being composed of six stages or more of the rotating blades, are symmetrically disposed right and left; the length of a blade portion of each of the rotating blades arranged from the upstream side to the downstream side of the steam flow is in a range of 80 to 1300 mm; and the length of the blade portion becomes larger from the upstream side to the downstream side, and the ratio between the lengths of the blade portions of the adjacent ones of the rotating blades is in a range of 1.2 to 1.8 (preferably, 1.4 to 1.6) and becomes gradually larger to the downstream side.

In the above low pressure steam turbine, preferably, the rotating blades have a double-flow structure in which two sets, each being composed of six stages or more, preferably, eight stages or more of the rotating blades, are symmetrically disposed right and left; the length of a blade portion of each of the rotating blades arranged from the upstream side to the downstream side of the steam flow is in a range of 80 to 1300 mm; the axial width of the portion, of the rotor shaft, corresponding to the stationary blade becomes stepwise larger from the upstream side to the downstream side, preferably, in three stages or more (more preferably, four to seven stages); and the ratio between the lengths of the blade portions of the adjacent ones of the rotating blades is in a range of 0.2 to 1.4 (preferably, 0.25 to 1.25, more preferably, 0.5 to 0.9) and becomes stepwise smaller to the downstream side.

In the above high pressure steam turbine, seven stages or more, preferably, nine stages or more of the rotating blades are provided; the diameter of the portion, of the rotor shaft, corresponding to the stationary blade is smaller than the rotating blade planted portion of the rotor shaft; the axial width of the portion corresponding to the stationary blade becomes stepwise larger from the downstream side to the upstream side of the steam flow in two steps or more (preferably, two or four steps); the width of the portion corresponding to the stationary blade between the final stage rotating blade and the preceding stage rotating blade is 0.75 to 0.95 times (preferably, 0.8 to 0.9 times, more preferably, 0.82 to 0.88 times) the width between the second stage rotating blade and the third stage rotating blade; the axial width of the rotating blade planted portion of the rotor shaft becomes stepwise larger from the upstream side to the downstream side of the steam flow in three steps or more (preferably, four to seven steps); and the axial width of the final stage rotating blade is 1 to 2 times (preferably, 1.4 to 1.7 times) the axial width of the second stage rotating blade.

In the above intermediate pressure steam turbine, preferably, six stages or more the rotating blades are provided; the diameter of the portion, of the rotor shaft, corresponding to the stationary blade is smaller than the diameter of the rotating blade planted portion of the rotor shaft; the axial width of the portion corresponding to the stationary blade becomes stepwise larger from the downstream side to the upstream side of the steam flow in two steps or more (preferably, three or six steps); the width of the portion corresponding to the stationary blade between the final stage rotating blade and the preceding stage rotating blade is 0.5 to 0.9 times (preferably, 0.65 to 0.75 times) the width between the first stage rotating blade and the second stage rotating blade; the axial width of the rotating blade planted portion of the rotor shaft becomes stepwise larger from the upstream side to the downstream side of the steam flow in two steps or more (preferably, three to six steps); and the axial width of the final stage rotating blade is 0.8 to 2 times (preferably, 1.2 to 1.5 times) the axial width of the final stage rotating blade.

In the above low pressure steam turbine, the rotating blades have a double-flow structure in which two sets, each being composed of eight stages or more of the rotating blades, are symmetrically disposed right and left; the diameter of the portion, of the rotor shaft, corresponding to the stationary blade is smaller than the rotating blade planted portion of the rotor shaft; the axial width of the portion corresponding to the stationary blade becomes stepwise larger from the downstream side to the upstream side of the steam flow, preferably, in three steps or more (more preferably, four or seventh steps); the width of the portion corresponding to the stationary blade between the final stage rotating blade and the preceding stage rotating blade is 1.5 to 3.0 times (preferably, 2.0 to 2.7 times) the width between the first stage rotating blade and the second stage rotating blade; the axial width of the rotating blade planted portion of the rotor shaft becomes stepwise larger from the upstream side to the downstream side of the stem flow, preferably, in three steps or more (preferably, four to seven steps); and the axial width of the final stage rotating blade is 5 to 8 times (preferably, 6.2 to 7.0 times) the axial width of the final stage rotating blade.

Each of the above high pressure turbine, intermediate pressure turbine, high pressure/intermediate pressure integral turbine, and low pressure turbine can be used at each of service steam temperatures in a range of 610 to 660° C. with the same structure.

It is desired to adjust the composition of the rotor material of the present invention, having a full temper martensite structure, such that the Cr equivalent calculated by the following equation is set in a range of 4 to 8 wt % for obtaining a high temperature strength, a high low temperature toughness, and a high fatigue strength.

The high pressure side turbine-intermediate pressure side turbine integral type steam turbine of the present invention is characterized in that seven stages or more, preferably, eight stages or more of the rotating blades are provided on the high pressure side and five stages or more, preferably, six stages or more of the rotating blades are provided on the intermediate pressure side; and the rotor shaft is made from a high strength martensite steel containing Cr in an amount of 9 to 13 wt %, the rotor shaft being specified such that a distance (L) between centers of bearings provided for the rotor shaft is 6000 mm or more (preferably, 6100 to 7000 mm), the minimum diameter (D) of portions, of the rotor shaft, corresponding to the stationary blades is 660 mm or more (preferably, 620 to 760 mm), and the ratio (L/D) is in a range of 8.0 to 11.3 (preferably, 9.0 to 10.0).

The low pressure steam turbine used in combination with the high pressure/intermediate pressure integral type turbine has the following feature. In the low pressure steam turbine, the rotating blades have a double-flow structure in which two sets, each being composed of five stages or more, preferably, six stages or more of the rotating blades, are symmetrically disposed right and left, and a first stage one of the rotating blades is planted at a central portion of the rotor shaft; the rotor shaft is made from a Ni—Cr—Mo—V based low alloy steel containing Ni in an amount of 3.25 to 4.25 wt %, the rotor shaft being specified such that a distance (L) between centers of bearings provided for the rotor shaft is 6500 mm or more (preferably, 6600 to 7500 mm), the minimum diameter (D) of portions, of the rotor shaft, corresponding to the stationary blades is 750 mm or more (preferably, 760 to 900 mm), and the ratio (L/D) is in a range of 7.8 to 10.0 (preferably, 8.0 to 9.0); and a final stage one of the rotating blades is made from a high strength martensite steel, the final stage rotating blade being specified such that a value of [the length of a blade (inch)×the number of revolution (rpm)] is 125,000 or more.

The above rotor shaft is made from a low alloy steel containing 0.2 to 0.3 wt % of C, 0.05 wt % or less of Si, 0.1 wt % or less of Mn, 3.0 to 4.5 wt % of Ni, 1.25 to 2.25 wt % of Cr, 0.007 to 0.20 wt % of Mc, and 0.07 to 0.2 wt % of V, the balance being 92.5 wt % or more of Fe, the rotor shaft being specified such that the diameter (D) of the portion, of the rotor shaft, corresponding to the stationary blade is in a range of 750 to 1300 mm and the diameter (L) between centers of bearings provided for the rotor shaft is 5.0 to 9.5 times the diameter (D).

The above rotating blades have a double-flow structure in which two sets, each being composed of five stages or more, preferably, six stages or more of the rotating blades are symmetrically provided right and left; the length of a blade portion of each of the rotating blades arranged from the upstream side to the downstream of the steam flow is in a range of 80 to 1300 mm; the diameter of the rotating blade planted portion of the rotor shaft is larger the diameter of the portion, of the rotor shaft, corresponding to the stationary blade; the axial root width of the rotating blade planted portion of the rotor shaft is extended downward to be larger than the blade planted portion and becomes stepwise smaller from the downstream side to the upstream side; and the ratio of the axial root width of the rotating blade planted portion to the length of the blade portion is in a range of 0.25 to 0.80.

The above rotating blades has a double-flow structure in which two sets, each being composed of five stages or more, preferably, six stages or more of the rotating blades are symmetrically provided right and left; the length of a blade portion of each of the rotating blades is in a range of 80 to 1300 mm and becomes gradually larger from the upstream side to the downstream side; and the ratio between the lengths of the blade portions of the adjacent ones of the rotating blades is in a range of 1.2 to 1.7.

The above rotating blades has a double-flow structure in which two sets, each being composed of five stages or more, preferably, six stages or more of the rotating blades are symmetrically provided right and left; the length of a blade portion of each of the rotating blades is in a range of 80 to 1300 mm and becomes larger from the upstream side to the downstream side; the axial root width of the rotating blade planted portion of the rotor shaft becomes larger from the upstream side to the downstream side at least in three steps, and is extend downward to be larger than the width of the rotating blade planted portion.

The high pressure side turbine-intermediate pressure side turbine integral type steam turbine according to the present invention has the following configuration:

Seven stages or more of the rotating blades are provided on the high pressure side; the length of a blade portion of each of the rotating blades arranged from the upstream side to the downstream side of the steam flow is in a range of 40 to 200 mm; the diameter of a rotating blade planted portion of the rotor shaft is larger than the diameter of a portion, of the rotor shaft, corresponding to the stationary shaft; the axial root width of the rotating blade planted portion becomes stepwise larger from the upstream side to the downstream side; the ratio of the axial root width of the rotating blade planted portion to the length of the blade portion is in a range of 0.20 to 1.60, preferably, 0.25 to 1.30 and becomes larger from the upstream side to the downstream side; and two sets, each being composed of five stages or more of the rotating blades, are symmetrically provided right and left on the intermediate pressure side; the length of a blade portion of each of the rotating blades arranged from the upstream side to the downstream side of the steam flow is in a range of 100 to 350 mm; the diameter of a rotating blade planted portion of the rotor shaft is larger than the diameter of a portion, of the rotor shaft, corresponding to the stationary shaft; the axial root width of the rotating blade planted portion becomes smaller from the upstream side to the downstream side except for the final stage; the ratio of the axial root width of the rotating blade planted portion to the length of the blade portion is in a range of 0.35 to 0.80, preferably, 0.40 to 0.75 and becomes smaller from the upstream side to the downstream side.

Further, seven stages or more of the rotating blades are provided on the high pressure side; the length of a blade portion of each of the rotating blades arranged from the upstream side to the downstream side of the steam flow is in a range of 25 to 200 mm; and the ratio between the lengths of the blade portions of the adjacent ones of the rotating blades is in a range of 1.05 to 1.35 and the length of the blade portion of 100 to 350 mm; and the ratio between the blade portions becomes gradually larger from the upstream side to the downstream side; and five stages or more of the rotating blades are provided on the intermediate pressure portion; the length of a blade portion of each of the rotating blades arranged from the upstream side to the downstream side is in a range of the adjacent ones of the rotating blades is in a range of 1.10 to 1.30 and the length of the blade portion of the rotating blade becomes gradually larger from the upstream side to the downstream side.

Further, six stages or more, preferably, seven stages or more of the rotating blades are provided on the high pressure side; the diameter of the portion, of the rotor shaft, corresponding to the stationary blade is smaller than the diameter of the rotating blade planted portion of the rotor shaft; the axial root width of ale rotating blade portion is widest at the first stage and becomes stepwise larger from the upstream side to the downstream side in two steps or more, preferably, in three steps or more; five stages or more of the rotating blades are provided on the intermediate pressure side; the diameter of the portion, of the rotor shaft, corresponding to the stationary blade is smaller than the diameter of the rotating blade planted portion of the rotor shaft; the axial root width of the rotating blade portion is stepwise changed on the upstream side as compared with the downstream side, preferably, in four steps or more; and the axial root width at the first stage is larger than that at the second stage, the axial root width at the final stage is larger than that at each of the other stages, and the axial root width at each of the first stage and the second stage is extended downward.

The present invention provides a steam turbine long blade characterized in that the steam turbine is made from a martensite steel containing 0.08 to 0.18 wt % of C, 0.25 wt % or less of Si, 0.90 wt % or less of Mn, 8.0 to 13.0 wt % of Cr, 2 to 3 wt % or less of Ni, 1.5 to 3.0 wt % of Mo, 0.05 to 0.35 wt % of V, 0.02 to 0.20 wt % in total of one kind or two kinds of Nb and Ta, and 0.02 to 0.10 wt % of N.

The above steam turbine long blade, which is required to withstand a high centrifugal force and a vibrational stress caused by high speed rotation, must be high in both the tensile strength and high cyclic fatigue strength. Consequently, the blade material is required to have a full temper martensite structure for eliminating the undesirable δ ferrite which significantly reduces the fatigue strength.

The inventive steel is characterized in that it does not contain a δ ferrite phase substantially by adjusting the composition such that the Cr equivalent calculated by the above equation is 10 or less.

The tensile strength of the long blade material steel is 120 kgf/mm$^2$ or more, preferably, 128.5 kgf/mm$^2$ or more.

To obtain a steam turbine long blade material which is homogeneous and high in strength, a forged product obtained from an ingot is subjected to the following heat-treatments [(quenching and temper (twice)]; namely, the product is kept at a temperature of 1000 to 1100° C., preferably, for 0.5 to 3 h and is rapidly cooled to room temperature (quenching), and heated to a temperature of 550 to 570° C. and kept at the temperature, preferably, for 1 to 6 h and cooled to room temperature (primary temper) and then heated to a temperature of 560 to 590° C. and kept at the temperature, preferably, for 1 to 6 h and cooled to room temperature (secondary temper).

According to the present invention, in the steam turbine (number of revolution: 3600 rpm), the length of the final stage blade portion of the low pressure turbine is set at 914 mm (36") or more, preferably, 965 mm (38") or more; and in the steam turbine (number of revolution: 3000 rpm), the length of the final stage blade portion of the low pressure turbine is set at 1092 mm (43") or more, preferably, 1168 mm (46") or more. Further, [the length of a blade portion (inch)]×the number of revolution (rpm)] is set at 125,000 or more, preferably, 138,000 or more.

In the heat resisting cast steel as the casing material according to the present invention, to enhance the high temperature strength, low temperature toughness and fatigue strength by adjusting the alloy composition such that the alloy has a temper martensite of 95% or more (δ ferrite: 5% or less), the alloy composition is preferably adjusted such that the Cr equivalent calculated by the following equation (the content of each element is expressed in wt %) is in a range of 4 to 10.

$$\text{Cr equivalent}=\text{Cr}+6\text{Si}+4\text{Mo}+1.5\text{W}+11\text{V}+5\text{Nb}-40\text{C}-30\text{N}-30\text{B}-2\text{Mn}-4\text{Ni}-2\text{Co}+2.5\text{Ta}$$

In the 12Cr based heat resisting steel of the present invention, particularly, when used in steam at a temperature of 625° C. or more, the material preferably exhibits a $10^5$ h creep rupture strength of 10 kgf/mm$^2$ or more and an impact absorption energy (at room temperature) of 1 kgf-m or more.

(1) There will be described the reason for limiting the content of each component of the 12% Cr based steel used for the final stage blade of the low pressure steam turbine according to the present invention.

C is required to be added in an amount of 0.08 wt % at minimum for ensuring the tensile strength. When C is added in an excessively large amount, the toughness is reduced. The content of C must be 0.20 wt % or less. In particular, the content of C is, preferably, 0.10 to 0.18 wt %, more preferably, 0.12 to 0.16 wt %.

Si and Mn are added upon melting of steel as a deoxidizer and a deoxidizing/desulfurizing agent, respectively. Such an effect can be obtained by addition of the element in a small amount. Si is a δ ferrite generating element, and therefore, the addition of Si in a large amount may cause undesirable δ ferrite which acts to reduce the fatigue and toughness. The content of Si must be 0.25 wt % or less. In the case of adopting a carbon/vacuum deoxidation process or an electroslag melting process, Si is not required to be added, and rather Si may be not added. In particular, the content of Si may be in a range of 0.10 wt % or less, preferably, in a range of 0.05 wt % or less.

The addition of Mn in a large amount reduces the toughness. The content of Mn must be 0.9 wt % or less. In particular, to improve the toughness, the content of Mn, which is effective as a deoxidizer, may in a range of 0.4 wt % or less, preferably, 0.2 wt % or less.

Cr is effective to increase the corrosion resistance and tensile strength of the alloy; however, the addition of Cr in an amount of 13 wt % or more may cause a δ ferrite structure. The addition of Cr in an amount of less than 8 wt % is insufficient for Cr to exhibit the effect of increasing the corrosion resistance and tensile strength. The content of Cr may be in a range of 8 to 13 wt %. To improve the strength, the content of Cr is preferably in a range of 10.5 to 12.5 wt %, more preferably, 11 to 12 wt %.

Mo is effective to increase the tensile strength of the alloy by its function of promoting solid-solution and precipitation. Such an effect, however, is not large so much, and the addition of Mo in an amount of 3 wt % or more may cause δ ferrite. The content of Mo is limited in a range of 1.5 to 3.0 wt %. In particular, the content of MO is preferably in a range of 1.8 to 2.7 wt %, more preferably, 2.0 to 2.5 wt %. It is to be noted that W and Co have the same effect as that of Mo.

V and Nb are effective to enhance the tensile strength and improve the toughness by the function of precipitating carbides. When the content of V is 0.05 wt % or less and the content of Nb is 0.02 wt % or less, the above effect is insufficient. The addition of V in an amount of 0.35 wt % or more and Nb in an amount of 0.2 wt % or more may cause δ ferrite. In particular, the content of V may be in a range of 0.15 to 0.30 wt %, preferably, 0.25 to 0.30 wt %; and the content of Nb may be in a range of 0.04 to 0.15 wt %, preferably, 0.06 to 0.12 wt %. It is to be noted that Ta may be added in place of or in combination with Nb.

Ni is effective to enhance the low temperature toughness and prevent occurrence of δ ferrite. When the content of Ni is 2 wt % or less, the effect cannot be sufficiently obtained. When it is more than 3 wt %, the addition effect is saturated. In particular, the content of Ni is preferably in a range of 2.3 to 2.9 wt %, more preferably, 2.4 to 2.8 wt %.

N is effective to improve the tensile strength and prevent occurrence of δ ferrite. When the content of N is less than 0.02 wt %, the effect cannot be sufficiently obtained. When it is more than 0.1 wt %, the toughness is reduced. In particular, the content of N is preferably in a range of 0.04 to 0.08 wt %, more preferably, 0.06 to 0.08 wt %.

The reduction in contents of Si, P and S is effective to increase the low temperature toughness while ensuring the tensile. The contents of Si, P and S are desired to be reduced as much as possible. To improve the low temperature toughness, the content of Si may be in a range of 0.1 wt % or less; the content of P may be in a range of 0.015 wt % or less; and the content of S may be in a range of 0.015 wt % or less. In particular, the content of Si is preferably in a range of 0.05 wt % or less; the content of P is preferably in a range of 0.010 wt % or less; and the content of S is preferably in a range of 0.010 wt % or less. The reduction in contents of Sb, Sn and As is also effective to increase the low temperature toughness, and therefore, the contents of Sb, Sn and As are desired to be reduced as much as possible. However, in consideration of the existing steel-making technical level, the content of Sb may be in a range of 0.0015 wt % or less; the content of Sn may be in a range of 0.01 wt % or less; and the content of As may be in a range of 0.02 wt % or less. In particular, the content of Sb is preferably in a range of 0.001 wt % or less; the content of Sn is preferably in a range of 0.005 wt % or less; and the content of As is preferably in a range of 0.01 wt % or less.

According to the present invention, the ratio (Mn/Ni) is preferably in a range of 0.11 or less.

The heat-treatment of the inventive material is preferably performed by uniformly heating the material at a temperature allowing perfect austenite transformation, that is, in a range of 1000 to 1100° C., followed by rapid cooling (preferably, oil-cooling) of the material; heating and keeping to and at a temperature of 550 to 570° C., followed by cooling of the material (primary temper); and heating and keeping to and at a temperature of 560 to 680° C., followed by cooling of the material (secondary temper), to thereby obtain a full temper martensite structure.

(2) There will be described a reason for limiting the content of each component of the ferrite based heat resisting steel, which is used for a rotor, blade, nozzle, inner casing fastening bolt and an intermediate pressure portion initial diaphragm in a high pressure turbine, an intermediate pressure turbine or a high pressure/intermediate pressure turbine of the inventive steam turbine operable at a temperature of 620 to 640° C.

C is an essential element for increasing the high temperature strength by ensuring the quenching ability and precipitating carbides at the tempering step. Also, to obtain the high tensile strength, C is required to be added in an amount of 0.05 wt % or more. However, when the content of C is more than 0.20 wt %, the metal structure becomes unstable upon the alloy is exposed to a high temperature atmosphere for a long time, to reduce the long time creep rupture strength. The content of C is limited in a range of 0.05 to 0.20 wt %, and is preferably in a range of 0.08 to 0.13 wt %, more preferably, 0.09 to 0.12 wt %.

Mn is added as a deoxidizer and the like. The effect can be obtained by the addition of Mn in a small amount. The addition of Mn in a large amount more than 1.5 wt % is undesirable because it reduces the creep rupture strength. In particular, the content of Mn is preferably in a range of 0.03 to 0.20 wt %, or in a range of 0.3 to 0.7 wt % more preferably, 0.35 to 0.65 wt %. The smaller content of Mn is effective to increase the strength, and the larger content of Mn is effective to improve machinability.

Si is added as a deoxidizer. However, in the case of adopting the steel-making technique such as carbon/vacuum deoxidization process, deoxidization by Si becomes unnecessary. The reduction in content of Si is effective to prevent occurrence of the undesirable δ ferrite structure and to prevent reduction in toughness due to segregation at crystal boundaries and the like. As a result, if Si is added, the content of Si should be limited in a range of 0.15 wt % or less, preferably, 0.07 wt % or less, more preferably, less than 0.04 wt %.

Ni is very effective to increase the toughness and prevent occurrence of δ ferrite. The effect cannot be sufficiently obtained by addition of Ni in an amount of less than 0.05 wt %. Meanwhile, the addition of Ni in an amount more than 1.0 wt % is undesirable because it reduces the creep rupture strength. In particular, the content of Ni is preferably in a range of 0.3 to 0.7 wt %, more preferably, 0.4 to 0.65 wt %.

Cr is an essential element for increasing the high temperature strength and the high temperature oxidation resistance. To achieve the effect, Cr must be added in an amount of 9 wt % at minimum. The addition of Cr in an amount more than 13 wt % may cause the undesirable δ ferrite structure, leading to reduction in the high temperature strength and toughness. The content of Cr is limited in a range of 9 to 12 wt %, preferably, in a range of 10 to 12 wt %, more preferably, 10.8 to 11.8 wt %.

Mo is added to improve the high temperature strength. In the steel containing W in an amount of more than 1 wt % like the inventive steel, however, the addition of Mo in an amount of 0.5 wt % or more reduces the toughness and the fatigue strength. The content of Mo is thus limited in a range of 0.5 wt % or less, preferably, 0.05 to 0.45 wt %, more preferably, 0.1 to 0.2 wt %.

W is an element of suppressing aggregation/coarsening of carbides and promoting solid-solution of a matrix, and therefore, W is effective to significantly increase the long time strength at a high temperature of 620° C. or more. The content of W is preferably in a range of 1 to 1.5 wt % for the alloy used at 620° C.; in a range of 1.6 to 2.0 wt % for the alloy used at 630° C.; in a range of 2.1 to 2.5 wt % for the alloy used at 640° C.; in a range of 2.6 to 3.0 wt % for the alloy used at 650° C.; and in a range of 3.1 to 3.5 wt % for the alloy used at 660° C. The addition of W in an amount of 3.5 wt % or more may cause occurrence of δ ferrit, leading to reduction in toughness. The content of W is thus limited in a range of 1 to 3.5 wt %, preferably, 2.4 to 3.0 wt %, more preferably, 2.5 to 2.7 wt %.

V is effective to increase the creep rupture strength by precipitating a carbonitride of V. The effect cannot be sufficiently achieved by addition of V in an amount of less than 0.05 wt %. The addition of V in an amount of more than 0.3 wt % may cause occurrence of δ ferrit, leading to reduction in fatigue strength. The content of V is preferably in a range of 0.10 to 0.25 wt %, more preferably, 0.15 to 0.23 wt %.

Nb is very effective to increase the high temperature strength by precipitating a carbide (NbC); however, the addition of Nb in an excessively large amount causes a coarsened eutectic carbide, particularly, in the case of a large-sized ingot, causing precipitation of δ ferrite which reduces the high temperature strength and fatigue strength. In this regard, the content of Nb is limited in a range of 0.20 wt % or less. Meanwhile, when the content of Nb is less than 0.01 wt %, the effect cannot be sufficiently achieved. In particular, the content of Nb may be in a range of 0.02 to 0.15 wt %, preferably, 0.04 to 0.10 wt %.

Co is an important element which is a factor distinguishing the inventive material from the conventional material. According to the present invention, the addition of Co is effective to significantly improve the high temperature strength as well as the toughness. This is due to interaction with addition of W, and is a phenomenon inherent to the inventive alloy containing W in an amount of 1 wt % or more. To realize the addition effect of Co, the lower limit of Co in the inventive alloy is set at 2.0 wt %. When Co is added in an excessively large amount, not only the effect is saturated but also the toughness is reduced. The upper limit of Co is set at 10 wt %. The content of Co is preferably in a range of 2 to 3 wt % for the alloy used at 620° C.; 3.5 to 4.5 wt % for the alloy used at 630° C.; 5 to 6 wt % for the alloy used at 640° C.; 6.5 to 7.5 wt % for the alloy used at 650° C.; and 8 to 9 wt % for the alloy used at 660° C.

N is also an important element which is another factor distinguishing the inventive material from the conventional material. N is effective to improve the creep rupture strength and prevent occurrence of the δ ferrite structure. When the content of N is 0.01 wt % or less, the effect cannot be sufficiently achieved, while when it is more than 0.05 wt %, the toughness is reduced and also the creep rupture strength is lowered. In particular, the content of N may be in a range of 0.01 to 0.03 wt %, preferably, 0.015 to 0.025 wt %.

B is effective to increase the high temperature strength by a function of strengthening crystal boundaries and a function of blocking aggregation/coarsening of a M23C6 type carbide because B is dissolved in the M23C6 type carbide in the solid state. To achieve the effect, B is must be added in an amount of 0.001 wt % or more; however, the addition of B in an amount more than 0.03 wt % exerts adverse effect on weldability and forging ability. The content of B is limited in a range of 0.001 to 0.03 wt %, preferably, 0.001 to 0.01 wt %, more preferably, 0.01 to 0.02 wt %.

Ta, Ti and Zr are effective to increase the toughness. To achieve the effect, 0.15 wt % or less of Ta, 0.1 wt % or less of Ti, and 0.1 wt % or less of Zr may be added singly or in combination. In the case of the addition of Ta in an amount of 0.1 wt % or more, the addition of Nb can be omitted.

The rotor shaft, at least the first stage rotating blade, and at least the first stage stationary blade according to the present invention, which are operated at a steam temperature of 620 to 630° C., are preferably made from a full temper martensite steel containing 0.09 to 0.20 wt % of C, 0.15 wt % or less of Si, 0.05 to 1.0 wt % of Mn, 9.5 to 12.5 wt % of Cr, 0.1 to 1.0 wt % of Ni, 0.05 to 0.30 wt % of V, 0.01 to 0.06 wt % of N, 0.05 to 0.5 wt % of Mo, 2 to 3.5 wt % of W, 2 to 4.5 wt % of Co, and 0.001 to 0.030 wt % of B, the balance being 77 wt % or more of Fe. The rotor shaft and the like, which are operated at a temperature of 635 to 660° C., are preferably made from a full temper martensite steel having the same composition as described above except that the content of Co is set in a range of 5 to 8 wt % and the balance is set at 78 wt % or more of Fe. Further, the rotor shaft and the like, which are operated at a temperature of 620 to 660° C., are preferably made from a steel having the same composition as described above except that the content of Mn is reduced to a value in a range of 0.03 to 0.2 wt % and the content of B is reduced to a value in a range of 0.001 to 0.01 wt % for increasing the strength. In particular, a steel suitable to be used at a temperature of 630° C. or less and a steel suitable to be used at a temperature of 630 to 660° C. are preferably obtained by addition of 2 to 4 wt % of Co and 0.001 to 0.01 wt % of B, and addition of 5.5 to 9.0 wt % of Co, and 0.01 to 0.03 wt % of B to a basic composition containing 0.09 to 0.20 wt % of C, 0.1 to 0.7 wt % of Mn, 0.1 to 1.0 wt % of Ni, 0.10 to 0.30 wt % of V, 0.02 to 0.05 wt % of N, 0.05 to 0.5 wt % of Mo, 2 to 3.5 wt % of W, respectively.

For the rotor shaft or the like, the Cr equivalent calculated by the equation to be described later is preferably in a range of 4 to 10.5, more preferably, 6.5 to 9.5.

The rotor material used for each of the high pressure turbine and the intermediate pressure turbine of the steam turbine of the present invention preferably has a uniform temper martensite structure because the presence of a δ ferrite structure reduces the fatigue strength and the toughness. To obtain the temper martensite structure, it is required to set the Cr equivalent calculated by the above equation in a range of 10 or less by adjusting the composition. When the Cr equivalent is excessively low, the creep rupture strength is reduced. The Cr equivalent is limited in a range of 4 or more. In particular, the Cr equivalent is preferably in a range of 5 to 8.

The steam turbine rotor, operable in steam at a temperature of 620° C. or more, of the present invention is produced in the following procedure. A raw material having a specific composition is melted in an electric furnace, followed by carbon/vacuum deoxidation, and cast in a metal mold to form an ingot. The ingot is then forged to prepare an electrode bar. The electrode bar is melted by an electroslag re-melting process to form an ingot, and the ingot is forged into a rotor shape. The forging must be performed at a temperature of 1150° C. or less for preventing occurrence of forging crack. The forged steel is annealed, and is subjected to quenching (quenching temperature: 1000 to 1100° C.) and to double temper (temper temperature: 550 to 650° C., 670 to 770° C.).

Each of the blade, nozzle, inner casing fastening bolt, intermediate pressure portion first stage diaphragm according to the present invention is vacuum-melted and is cast in a die in vacuum to prepare an ingot. The ingot is hot-forged at the same temperature as described above into a specific shape. The forged steel is heated at a temperature of 1050 to 1150° C. and water-quenched or oil-quenched, followed by temper at a temperature of 700 to 800° C., and is machined into a blade having a specific shape. The vacuum melting is performed under a vacuum of $10^{-1}$ to $10^{-4}$ mm Hg. The heat resisting steel of the present invention can be used for all stages of blades and nozzles of each of the high pressure portion and the intermediate pressure portion, and particularly, the steel is required to be used for the first stage blade and nozzle.

(3) There will be described the composition of a material used for a rotor shaft of each of the high pressure turbine, intermediate pressure turbine or high pressure/intermediate pressure integral type turbine of the steam turbine of the present invention, which is operable at a temperature of 600 to less than 620° C.

C is required to be added in an amount of 0.05 wt % or more for increasing the tensile strength; however, when the content of C is more than 0.25 wt %, the structure becomes unstable when the alloy is exposed to a high temperature atmosphere for a long time, leading to reduction in long time creep rupture strength. The content of C is limited in a range of 0.05 to 0.25 wt %, preferably, 0.1 to 0.2 wt %.

Nb is very effective to increase the high temperature strength. However, the addition of Nb in an excessively large amount precipitates a corsened carbide of Nb, particularly, for a large-sized ingot; reduces the concentration of C in the matrix, resulting in the reduced strength; and precipitate δ ferrite which reduces the fatigue strength. The content of Nb must be limited in a range of 0.15 wt % or less. Meanwhile, when the content of Nb is less than 0.02 wt %, the effect cannot be sufficiently achieved. The content of Nb is preferably in a range of 0.07 to 0.12 wt %.

N is effective to improve the creep rupture strength and prevent generation of δ ferrite. When the content of N is less than 0.025 wt %, the effect cannot be sufficiently achieved. When it is more than 0.1 wt %, the toughness is significantly reduced. The content of N is preferably in a range of 0.04 to 0.07 wt %.

Cr is effective to increase the high temperature strength. However, the addition of Cr in an amount more than 13 wt % causes occurrence of δ ferrite, and the addition of Cr in an amount of less than 8 wt % makes poor the corrosion resistance against high temperature/high pressure steam. The content of Cr is preferably in a range of 10 to 11.5 wt %.

V is effective to increase the creep rupture strength. When the content of V is less than 0.02 wt %, the effect cannot be sufficiently achieved, while when it is more than 0.5 wt %, there occurs δ ferrite which reduces the fatigue strength. The content of V is preferably in a range of 0.1 to 0.3 wt %.

Mo is effective to improve the creep strength by a function of reinforcement of solid-solution and precipitation hardening. When the content of Mo is less than 0.5 wt %, the effect cannot be sufficiently achieved, while when it is more than 2 wt %, there occurs δ ferrite which reduces the toughness and creep rupture strength. In particular, the content of Mo is preferably in a range of 0.75 to 1.5 wt %.

Ni is very effective to increase the toughness and prevent occurrence of δ ferrite. However, the addition of Ni in an amount more than 1.5 wt % undesirably reduces the creep rupture strength. The content of Ni is preferably in a range of 0.4 to 1 wt %.

Mn is added as a deoxidizer. The effect can be achieved by the addition of a small amount of Mn. The addition of Mn in a large amount more than 1.5 wt % reduces the creep rupture strength. The content of Mn is preferably in a range of 0.5 to 1 wt %.

Si is also added as a deoxidizer. However, in the case of adopting a steel-making technique such as vacuum/carbon deoxidation, the deoxidization by Si becomes unnecessary. The reduction in the content of Si is effective to prevent precipitation of δ ferrite and improve the toughness. For this reason, the content of Si must be limited in a range of 0.6 wt % or less. If it is added, the content of Si is preferably set at 0.25 wt %.

W is an element capable of significantly increasing the high temperature strength in a slight amount. When the content of W in an amount less then 0.1 wt %, the effect is small, while when it is more than 0.65 wt %, the strength is rapidly reduced. The content of W should be in a range of 0.1 to 0.65 wt % or less. On the other hand, when the content of W in an amount more than 0.5 wt %, the toughness is significantly reduced. For a member requiring the toughness, the content of W may be set at a value less than 0.5 wt %. The content of W is preferably in a range of 0.2 to 0.45 wt %.

Al is an effective element as a deoxidizer. The content of Al may be set at 0.02 wt % or less. The addition of Al in an amount more than 0.02 wt % reduces the high temperature strength.

(4) As for the rotor shaft of the steam turbine, made from the 12% Cr based martensite steel according to the present invention, buildup layers having a high bearing characteristic are preferably formed by welding on the surface of a base material for forming a jounal portion of the rotor shaft. To be more specific, three to ten buildup layers may be formed by welding using a welding material made from a steel. In this case, the first, second, third, and fourth layers are built up by welding using welding materials of which the Cr contents are sequentially lowered, and the fifth layer and the later layers are built up by welding using welding materials of which the Cr contents are identical to each other. Further, the Cr content of the welding material used for welding of the first layer is smaller 2 to 6 wt % than that of the base material, and the Cr content of each of the fourth layer and the later layers is set at 0.5 to 3 wt % (preferably, 1 to 2.5 wt %).

In the present invention, to improve the bearing characteristic of the jounal portion, buildup welding is preferable in terms of high safety. The buildup welding, however, may replaced with shrinkage fit or insertion of a sleeve made from a low alloy steel containing Cr in an amount of 1 to 3 wt %.

To gradually change the content of Cr in buildup layers, it is desired to provide three layers or more; however, if ten layers or more are provided, the effect is saturated. The total thickness of the buildup layers is represented by about 18 mm after final finishing. To ensure such a total thickness, it is desired to provide at least five buildup layers excluding a cutting allowance for final finishing. Each of the third layer and the later layers preferably has a martensite structure in which a carbide is precipitated. In particular, the welding layer of each of the fourth layer and the later layers preferably contains 0.01 to 0.1 wt % of C, 0.3 to 1 wt % of Si, 0.3 to 1.5 wt % of Mn, 0.5 to 3 wt % of Cr, and 0.1 to 1.5 wt % of Mo, the balance being Fe.

(5) There will be described a reason for limiting the content of each component of the ferrite based heat resisting steel used for an inner casing governor valve box, combination re-heat valve box, main steam lead pipe, main steam inlet pipe, re-heat inlet pipe, high pressure turbine nozzle box, intermediate pressure turbine first stage diaphragm, high pressure turbine main steam inlet flange, elbow, and main steam stop valve of each of the high pressure turbine, intermediate pressure turbine, and high pressure/intermediate pressure turbine.

By adjusting the Ni/W ratio in a range of 0.25 to 0.75, the ferrite based heat resisting cast steel as the casing material satisfies characteristics required for the high pressure and intermediate pressure inner casings, main steam stop valve and governor valve casing of an ultrasuper critical pressure turbine operated at 621° C. and 250 kgf/cm$^2$ or more, that is, exhibits a $10^5$ h creep rupture strength (at 625° C.) of 9 kgf/mm$^2$ or more and an impact absorption energy (at room temperature) of 1 kgf-m or more.

In the ferrite based heat resisting cast steel as the casing material according to the present invention, to obtain a high temperature strength, a low temperature toughness, and a high fatigue strength, it is desired to adjust the composition such that the Cr equivalent calculated by the above equation is in a range of 4 to 10.

The 12% Cr based heat resisting steel of the present invention, which is operated in steam at a temperature of 621° C. or more, must exhibit a $10^5$ h creep rupture strength (at 625° C.) of 9 kgf/mm$^2$ or more and an impact absorption energy (at room temperature) of 1 kgf-m or more, and to ensure a higher reliability, it preferably exhibits a $10^5$ h creep rupture strength (at 625° C.) of 10 kgf/mm$^2$ or more and an impact absorption energy (at room temperature) of 2 kgf-m or more.

C is required to be added in an amount of 0.06 wt % or more for increasing the tensile strength. When the content of C is more than 0.16 wt %, the metal structure becomes unstable when the alloy is exposed to a high temperature atmosphere for a long time, leading to reduction in long time creep rupture strength. The content of C is limited in a range of 0.06 to 0.16 wt %, preferably, 0.09 to 0.14 wt %.

N is effective to improve the creep rupture strength and prevent occurrence of a δ ferrite. When the content of N is less than 0.01 wt %, the effect cannot be sufficiently achieved, while when it is more than 0.1 wt %, the effect is already saturated, and the toughness is reduced and the creep rupture strength is lowered. The content of N is preferably in a range of 0.02 to 0.06 wt %.

Mn is added as a deoxidizer. The effect can be achieved by the addition of a small amount of Mn. The addition of Mn in an amount more than 1 wt % reduces the creep rupture strength. The content of Mn is preferably in a range of 0.4 to 0.7 wt %.

Si is also added as a deoxidizer. However, in the case of adopting a steel-making technique such as vacuum/carbon deoxidation, the deoxidization by Si becomes unnecessary.

The reduction in content of Si is effective to prevent occurrence of a undesirable δ ferrite structure. If Si is added, the content of Si must be limited in a range of 0.5 wt % or less, preferably, 0.1 to 0.4 wt %.

V is effective to increase the creep rupture strength. When the content of V is less then 0.05 wt %, the effect cannot be sufficiently achieved, while when it is more than 0.35 wt %, there occurs δ ferrite which reduces fatigue strength. The content of V is preferably in a range of 0.15 to 0.25 wt %.

Nb is very effective to increase the high temperature strength. However, the addition of Nb in an excessively large amount causes a coarsened eutectic carbide of Nb, particularly, in the case of a large-sized ingot, to rather reduce the strength and precipitate δ ferrite which reduces the fatigue strength. The content of Nb is limited in a range of 0.15 wt % or less. When the content of Nb is less than 0.01 wt %, the effect cannot be sufficiently achieved. In the case of a large-sized ingot, particularly, the content of Nb may be in a range of 0.02 to 0.1 wt %, preferably, 0.04 to 0.08 wt %.

Ni is very effective to increase the toughness and prevent occurrence of δ ferrite. When the content of Ni is less than 0.2 wt %, the effect cannot be sufficiently achieved, while when it is more than 1.0 wt %, the creep rupture strength is undesirably reduced. The content of Ni is preferably in a range of 0.4 to 0.8 wt %.

Cr is effective to improve the high temperature strength and high temperature oxidation. When the content of Cr is more than 12 wt %, there occurs a undesirable δ ferrite structure, while when it is less than 8 wt %, the oxidation resistance against high temperature/high pressure steam becomes insufficient. The addition of Cr is effective to increase the creep rupture strength; however, excessively large amount of Cr causes a undesirable δ ferrite structure and reduces the toughness. The content of Cr is preferably in a range of 8.0 to 10 wt %, more preferably, in a range of 8.5 to 9.5 wt %.

W is effective to significantly increase the high temperature/long time strength. When the content of W is less than 1 wt %, the effect becomes insufficient if the heat resisting steel is used at a temperature of 620 to 660° C., while when it is more than 4 wt %, the toughness is reduced. The content of W is preferably in a range of 1.0 to 1.5 wt % for the alloy used at 620° C.; in a range of 1.6 to 2.0 wt % for the alloy used at 630° C.; in a range of 2.1 to 2.5 wt % for the alloy used at 640° C.; in a range of 2.6 to 3.0 wt % for the alloy used at 650° C.; and in a range of 3.1 to 3.5 wt % for the alloy used at 660° C.

W has interaction with Ni, and both the strength and toughness can be increased by setting the ratio Ni/W in a range of 0.25 to 0.75.

Mo is effective to increase the high temperature strength. However, for the alloy containing W in an amount more than 1 wt % like the cast steel of the present invention, the addition of Mo in an amount of 1.5 wt % or more reduces the toughness and fatigue strength. The content of Mo to be added is limited in the range of 1.5 wt % or less, preferably, 0.4 to 0.8 wt %, more preferably, 0.55 to 0.70 wt %.

Ta, Ti and Zr are effective to increase the toughness. To achieve the effect, 0.15 wt % or less of Ta, 0.1 wt % or less of Ti, and 0.1 wt % or less of Zr may be added singly or in combination. In the case of the addition of Ta in an amount of 0.1 wt % or more, the addition of Nb can be omitted.

The heat resisting cast steel as the casing material of the present invention preferably has a uniform temper martensite structure because the presence of a δ ferrite structure reduces the fatigue strength and the toughness. To obtain the temper martensite structure, it is required to set the Cr equivalent calculated by the above equation in a range of 10 or less by adjusting the composition. When the Cr equivalent is excessively low, the creep rupture strength is reduced. The Cr equivalent is limited in a range of 4 or more. In particular, the Cr equivalent is preferably in a range of 6 to 9.

B is effective to significantly increase the creep rupture strength at high temperatures (620° C. or more). The addition of B in an amount more than 0.003 wt % degrades weldability, and therefore, the upper limit of the content of B is set at 0.003 wt %. In the case of the alloy used for a large-sized casing, the upper limit of the content of B may be set at 0.0028 wt %. The content of B is preferably in a range of 0.0005 to 0.0025 wt %, more preferably, 0.001 to 0.002 wt %.

The casing, which covers high pressure steams at a temperature of 620° C. or more, is applied with a high stress due to an inner pressure. Accordingly, to prevent occurrence of creep rupture, the casing is required to exhibit a $10^5$ h creep rupture strength of 10 kgf/mm$^2$ or more. Further, since the casing is applied with a thermal stress when the metal temperature is low upon starting, it must exhibit an impact absorption energy (at room temperature) of 1 kgf-m or ore for preventing occurrence of brittle fracture. For the casing material used on the higher temperature side, its strength can be increased by addition of Co in an amount of 10 wt % or less. To be specific, the content of Co is preferably in a range of 1 to 2 wt % for the alloy used at 620° C.; in a range of 2.5 to 3.5 wt % for the alloy used at 630° C.; in a range of 4 to 5 wt % for the alloy used at 640° C.; in a range of 5.5 to 6.5 wt % for the alloy used at 650° C.; and in a range of 7 to 8 wt % for the alloy used at 660° C. For the alloy used at a temperature of 600 to 620° C., Co may be not added.

To produce a casing material with less defects, a large-size ingot having a weight of about 50 ton must be prepared, which requires a high level steel-making technique. The heat resisting cast steel as the casing material of the present invention is produced by melting a raw material having a specific composition in an electric furnace, followed by ladle refining, and casting molten steel in a sand mold. In this case, a high quality ingot with less casting defects such as shrinkage cavities can be obtained by sufficiently refining and deoxidizing molten steel before casting.

The above cast steel is annealed at a temperature of 1000 to 1150° C., and heated at a temperature of 1000 to 1100° C. and rapidly cooled (normalizing), followed by double temper (550 to 750° C., 670 to 770° C.), to obtain a steam turbine casing operable in steam at a temperature of 621° C. or more. When each of the annealing temperature and normalizing temperature is less than 1000° C., a carbonitride cannot be sufficiently dissolved in the solid-state, while when it is excessively high, there may occur coarsening of crystal grains. The double temper perfectly decomposes retained austenite to form a uniform temper martensite. In accordance with the above process, there can be produced a steam turbine casing having a $10^5$ h creep rupture strength (at 625° C.) of 10 kgf/mm$^2$ or more and an impact absorption energy (at room temperature) of 1 kgf-m or more. Such a casing is operable in steam at a temperature of 620° C. or more.

When the content of O is more than 0.015 wt %, the high temperature strength and the toughness are reduced, and therefore, the content of O is limited in a range of 0.015 wt % or less, preferably, 0.010 wt % or less.

For the casing material of the present invention, the Cr equivalent is set at the same value as described above to reduce the δ ferrite amount to a value of 5 wt % or less. The δ ferrite amount is preferably reduced to zero.

While the inner casing is made from a cast steel, the other parts are preferably made from forged steels.

(6) Others (A) The rotor shaft for the low pressure steam turbine is preferably made from a low alloy steel which contains 0.2 to 0.3 wt % of C, 0.1 wt % or less of Si, 0.2 wt % or less of Mn, 3.2 to 4.0 wt % of Ni, 1.25 to 2.25 wt % of Cr, 0.1 to 0.6 wt % of Mo, and 0.05 to 0.25 wt % of V, and which has a full temper bainite structure. This rotor shaft is preferably produced in the same manner as that for the above rotor shaft of the high pressure or intermediate pressure steam turbine. In particular, the rotor shaft is preferably produced by a super clean process using a raw material in which the amount of Si is reduced to a value of 0.05 wt % or less, the amount of Mn is reduced to a value of 0.1 wt % or less, and the total amount of other impurities such as P, S, As, Sb and Sn is reduced as much as possible, for example, to a value 0.025 wt % or less. In this case, the amount of each of P and S is preferably in a range of 0.010 wt % or less; the amount of each of Sn and As is preferably in a range of 0.005 wt % or less; and the amount of Sb is preferably in a range of 0.001 wt % or less.

(B) The final stage blade and nozzle for the low pressure turbine is preferably made form a full temper martensite steel containing 0.05 to 0.2 wt % of C, 0.1 to 0.5 wt % of Si, 0.2 to 1.0 wt % of Mn, 10 to 13 wt % of Cr, and 0.04 to 0.2 wt % of Cr.

(C) The inner casing and outer casing for the low pressure turbine are preferably made from a carbon cast steel containing 0.2 to 0.3 wt % of C, 0.3 to 0.7 wt % of Si, and 1 wt % of Mn.

(D) The main steam stop valve casing and steam governor valve casing are preferably made from a full temper martensite steel containing 0.1 to 0.2 wt % of C, 0.1 to 0.4 wt % of Si, 0.2 to 1.0 wt % of Mn, 8.5 to 10.5 wt % of Cr, 0.3 to 1.0 wt % of Mo, 1.0 to 3.0 wt % of W, 0.1 to 0.3 wt % of V, 0.03 to 0.1 wt % of Nb, 0.03 to 0.08 wt % of N, and 0.0005 to 0.003 wt % of B.

(E) As the final stage rotating blade for the low pressure turbine, there may be used a Ti alloy in place of the 12% Cr based steel. In particular, the final stage rotating blade having a length of 40 inches or more is made from a Ti alloy containing 5 to 8 wt % of Al and 3 to 6 wt % of V; the blade having a length of 43 inches is made from a high strength Ti alloy containing 5.5 to 6.5 wt % of Al and 3.5 to 4.5 wt % of V; and the blade having a length of 46 inches is made from a higher Ti alloy containing 4 to 7 wt % of Al, 4 to 7 wt % of V and 1 to 3 wt % of Sn.

(F) The outer casing for each of the high pressure turbine, intermediate pressure turbine and high pressure/intermediate pressure turbine is made from a cast steel which contains 0.10 to 0.20 wt % of C, 0.05 to 0.6 wt % of Si, 0.1 to 1.0 wt % of Mn, 0.1 to 0.5 wt % of Ni, 1 to 2.5 wt % of Cr, 0.5 to 1.5 wt % of Mo, and 0.1 to 0.35 wt % of V, and preferably, at least one of 0.025 wt % or less of Al, 0.0005 to 0.004 wt % of B, and 0.05 to 0.2 wt % of Ti, and which has a full temper bainite structure. In particular, there is preferably used a cast steel containing 0.10 to 0.18 wt % of C, 0.20 to 0.60 wt % of Si, 0.20 to 0.50 wt % of Mn, 0.1 to 0.5 wt % of Ni, 1.0 to 1.5 wt % of Cr, 0.9 to 1.2 wt % of Mo, 0.2 to 0.3 wt % of V, 0.001 to 0.005 wt % of Al, 0.045 to 0.10 wt % of Ti, and 0.0005 to 0.0020 wt % of B. In this composition, more preferably, the Ti/Al ratio is in a range of 0.5 to 10.

(G) The first stage blade for each of the high pressure turbine, intermediate pressure turbine, and high pressure/intermediate pressure turbine (high pressure side and the intermediate pressure side) at a steam temperature of 625 to 650° C. is made from a Ni based alloy containing 0.03 to 0.20 wt % (preferably, 0.03 to 0.15 wt %), 12 to 20 wt % of Cr, 9 to 20 wt % of Mo (preferably, 12 to 20 wt %), 12 wt % or less of Co (preferably, 5 to 12 wt %), 0.5 to 1.5 wt % of Al, 1 to 3 wt % of Ti, 5 wt % or less of Fe, 0.3 wt % or less of Si, 0.2 wt % or less of Mn, 0.003 to 0.015 wt % of B, and one kind or more of 0.1 wt % or less of Mg, 0.5 wt % or less of a rare earth element and 0.5 wt % or less of Zr. In addition, the wording "or less" contains 0 wt %. The above alloy is forged, followed by solution treatment, and subjected to ageing treatment at a temperature of 700 to 870° C.

BEST MODE FOR CARRYING OUT THE INVENTION

Embodiment 1

Figure 1:
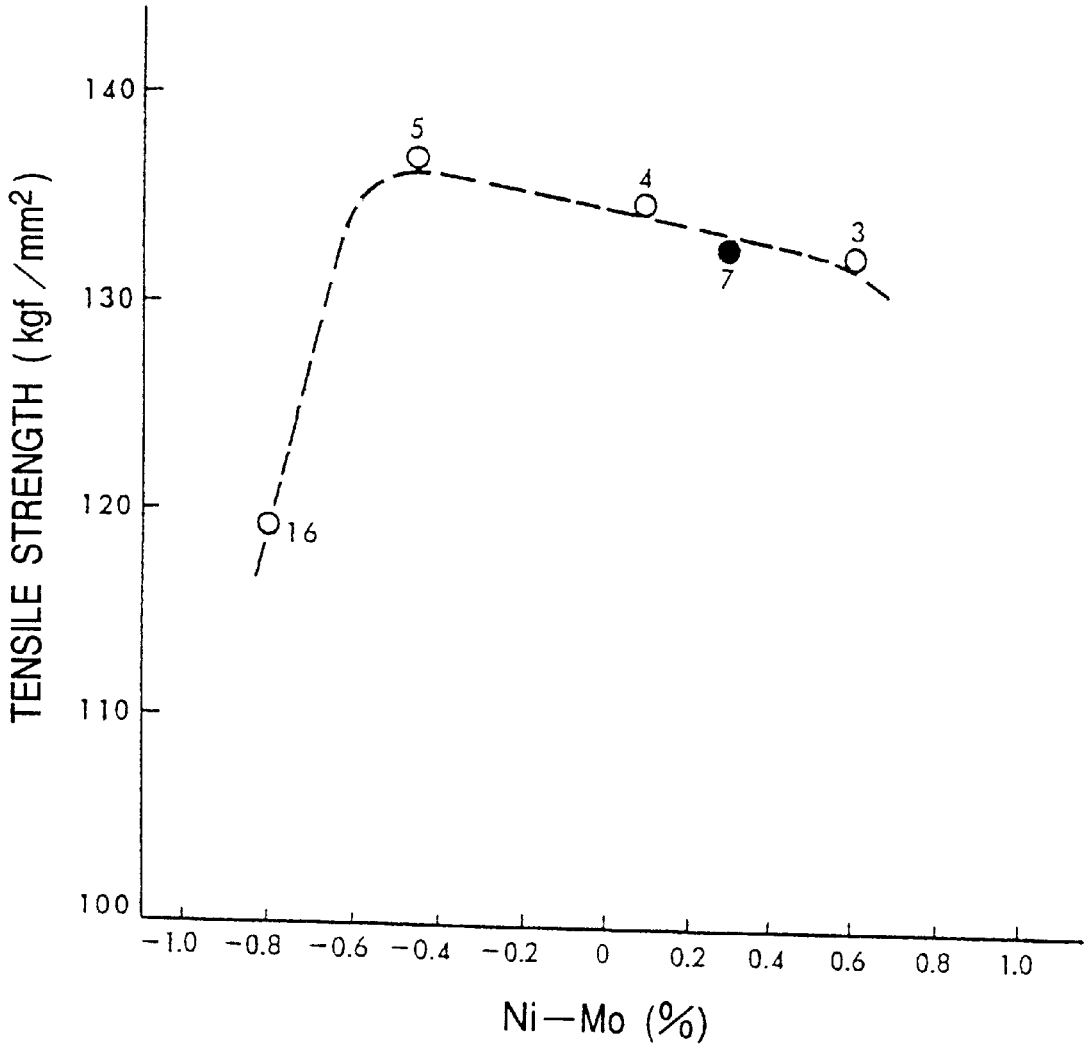
FIG. 1 is a diagram showing a relationship between a tensile strength and a (Ni—Mo) amount (wt %)

Table 1 shows chemical compositions (wt %) of 12% Cr based steels used as long blades materials for steam turbines. Each sample of 150 kg was melted by a vacuum arc melting process, being heated to a temperature less than 1150° C., and forged, to prepare an experimental material. Sample No. 1 was heated at 1000° C. for one hour and cooled to room temperature by oil quenching, and then heated to and kept at 570° C. for two hours and air-cooled. Sample No. 2 was heated at 1050° C. for one hour and cooled to room temperature by oil quenching, and then heated to and kept at 570° C. for two hours and air-cooled. Each of Sample Nos.

3 to 6 was heated at 1050° C. for one hour and cooled to room temperature by oil quenching, and then heated to and kept at 560° C. for two hours and air-cooled (primary temper), and further heated to and kept at 580° C. for two hours and furnace-cooled (secondary temper).

In Table 1, Sample Nos. 3, 4 and 5 are inventive materials; Sample No. 6 is a comparative material; and Sample Nos. 1 and 2 are existing long blade materials.

Table 2 shows mechanical properties of these samples at room temperature. From the results shown in Table 2, it is revealed that each of the inventive materials (Sample Nos. 3 to 5) sufficiently satisfies a tensile strength (120 kgf/mm$^2$ or more, or 128.5 kgf/mm$^2$ or more) and a low temperature toughness (Charpy V-notch impact value (at 20° C.): 2.5 kgf-m/cm$^2$ or more) which are required for a long blade material for a steam turbine.

On the contrary, each of Sample Nos. 1 and 6 as the comparative materials exhibits a tensile strength and an impact value which are lower than those required for a long blade for a steam turbine. Sample No. 2 as the comparative material is low in tensile strength and toughness. Sample No. 5 exhibits an impact value of 3.8 kgf-m/cm$^2$ which is slightly lower than a value of 4 kgf-m/cm$^2$ or more required for a long blade of 43 inches or more.

TABLE 1

| No. | C | Si | Mn | Cr | Ni | Mo | W | V | Nb | N | Ni—Mo | Nb/C | C + Nb | Nb/N |
|---|---|---|---|---|---|---|---|---|---|---|---|---|---|---|
| 1 | 0.12 | 0.15 | 0.75 | 11.5 | 2.60 | 1.70 | — | 0.36 | — | 0.03 | 0.90 | — | — | — |
| 2 | 0.28 | 0.28 | 0.71 | 11.6 | 0.73 | 1.10 | 1.12 | 0.21 | — | 0.04 | — | — | — | — |
| 3 | 0.14 | 0.04 | 0.16 | 11.4 | 2.70 | 2.10 | — | 0.26 | 0.08 | 0.06 | 0.60 | 0.57 | 0.22 | 1.33 |
| 4 | 0.13 | 0.04 | 0.15 | 11.5 | 2.50 | 2.40 | — | 0.28 | 0.10 | 0.05 | 0.10 | 0.77 | 0.23 | 2.0 |
| 5 | 0.13 | 0.06 | 0.15 | 11.4 | 2.65 | 3.10 | — | 0.25 | 0.11 | 0.06 | −0.45 | 0.85 | 0.22 | 1.83 |
| 6 | 0.14 | 0.04 | 0.17 | 11.4 | 2.61 | 3.40 | — | 0.26 | 0.10 | 0.06 | −0.79 | 0.71 | 0.24 | 1.67 |
| 7 | 0.14 | 0.04 | 0.15 | 11.5 | 2.60 | 2.30 | — | 0.27 | 0.10 | 0.07 | 0.30 | 0.71 | 0.24 | 1.43 |

TABLE 2

| Sample No. | Tensile strength (kgf/mm$^2$) | Elongation (%) | Reduction of area (%) | Impact value (kgf-m/cm$^2$) |
|---|---|---|---|---|
| 1 | 114.4 | 19.0 | 60.1 | 8.0 |
| 2 | 114.6 | 18.6 | 59.7 | 1.2 |
| 3 | 132.5 | 21.0 | 67.1 | 5.2 |
| 4 | 134.9 | 20.8 | 66.8 | 4.8 |
| 5 | 137.0 | 18.5 | 59.8 | 3.8 |
| 6 | 118.7 | 21.1 | 67.3 | 5.2 |
| 7 | 133.5 | 20.1 | 60.4 | 5.1 |

FIG. 1 is a diagram showing a relationship between a (Ni—Mo) amount and a tensile strength. In this embodiment, both a strength and toughness at a low temperature are improved by adjusting the contents of Ni and Mo to be substantially equal to each other. As a difference between the contents of Ni and Mo becomes larger, the strength becomes lower. As shown in FIG. 1, when the Ni content is smaller, 0.6% or more, than the Mo content, the strength is rapidly lowered. On the contrary, when the Ni content is larger, 1.0% or more, than the Mo content, the strength is also rapidly lowered. As a result, the (Ni—Mo) amount suitable for enhancing the strength is in a range of −0.6% to 1.0%.

Figure 2:
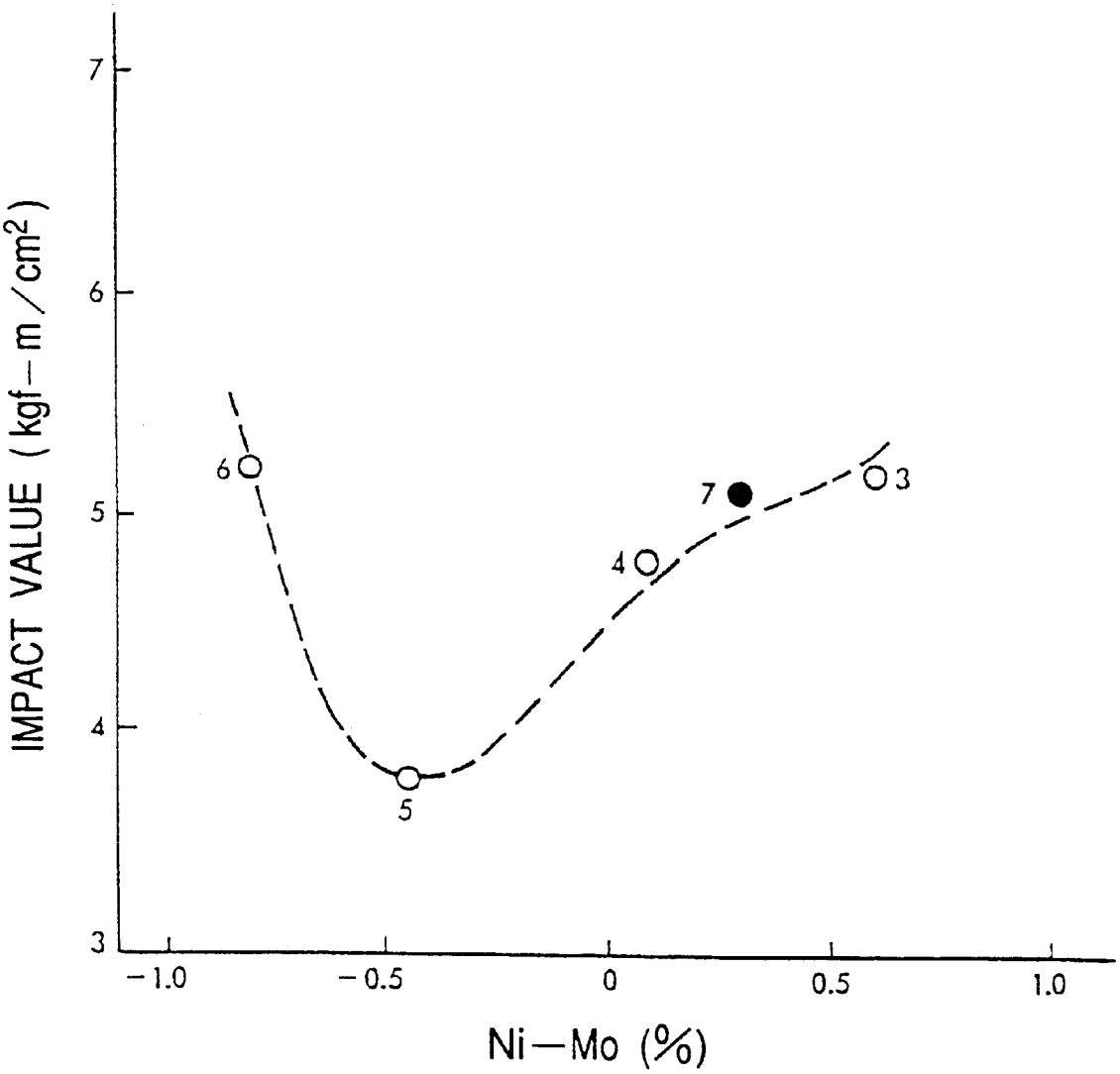
FIG. 2 is a diagram showing a relationship between an impact value and a (Ni—Mo) amount (wt %)

FIG. 2 is a diagram showing a relationship between a (Ni—Mo) amount and an impact value. As shown in the figure, the impact value is low near −0.5% of the (Ni—Mo) amount, and is high in regions less than −0.5% and more than 0.5% of the (Ni—Mo) amount.

Figure 3:
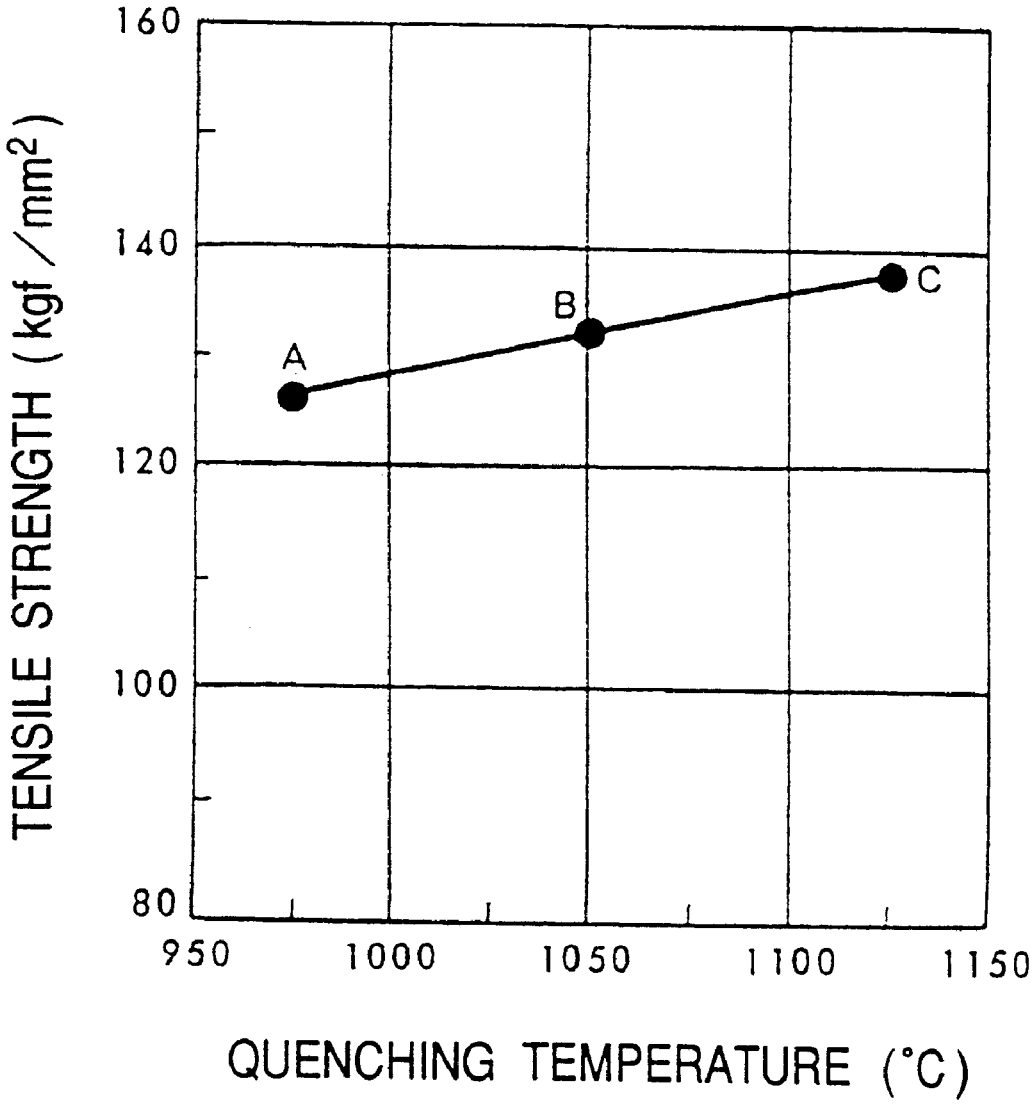
FIG. 3 is a diagram showing a relationship between a tensile strength and a quenching temperature.
Figure 4:
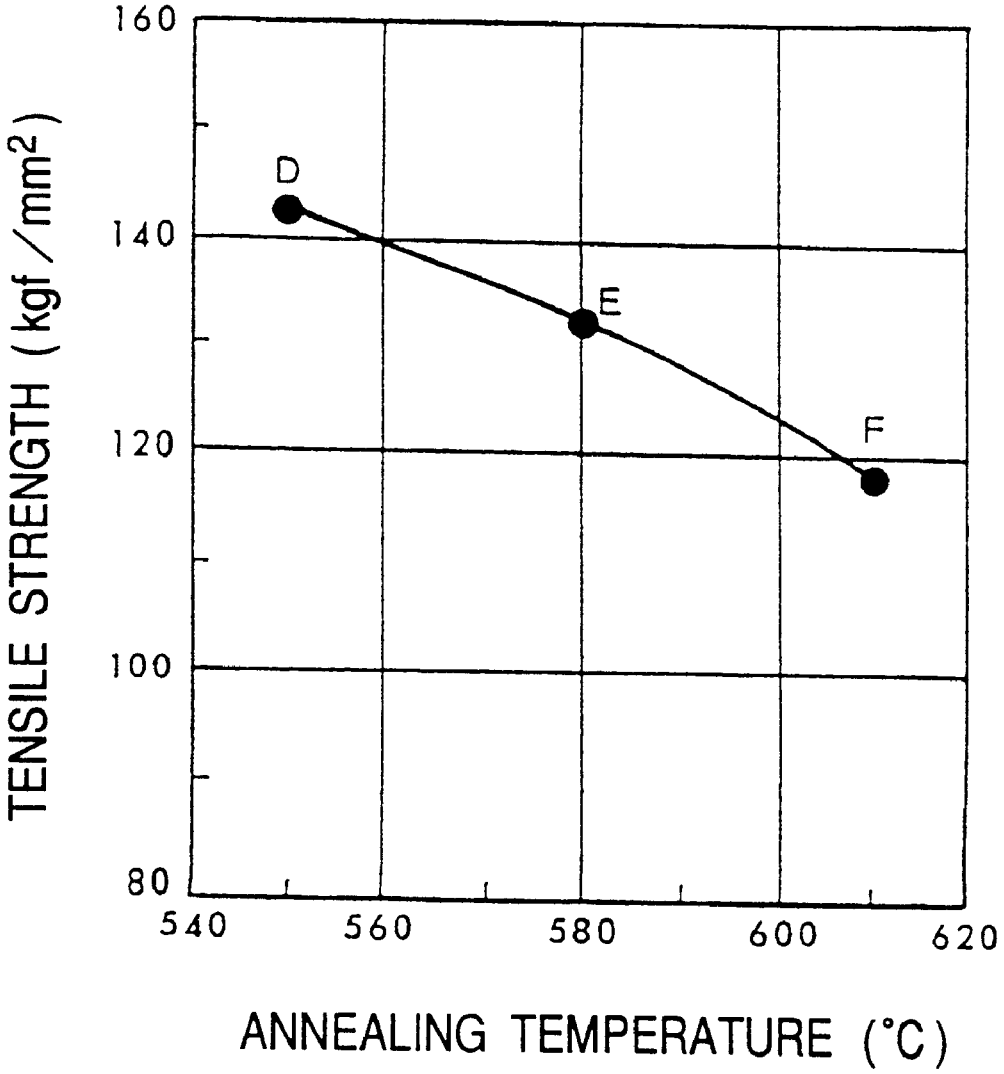
FIG. 4 is a diagram showing a relationship between a tensile strength and a temper temperature.
Figure 5:
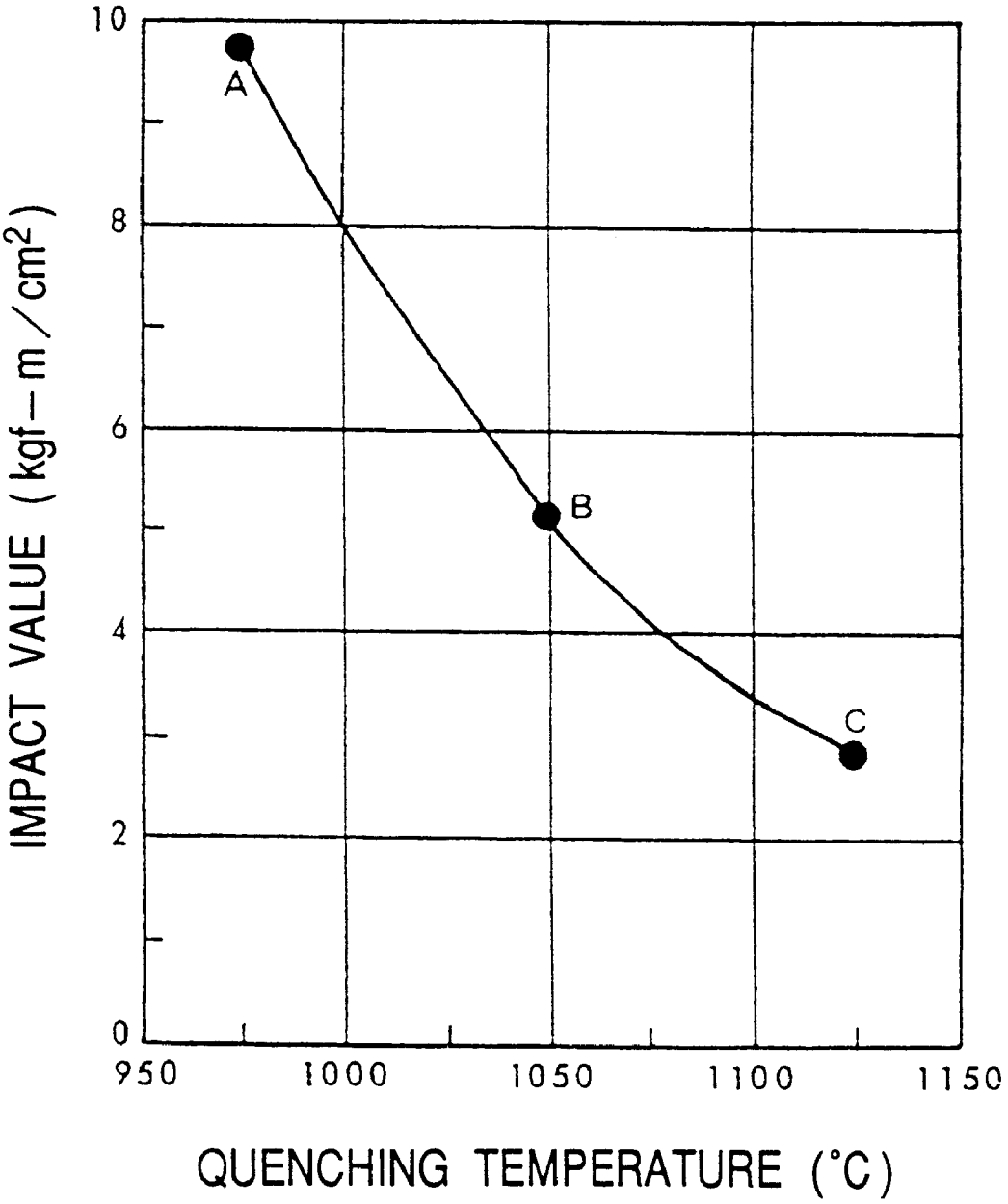
FIG. 5 is a diagram showing a relationship between an impact value and a quenching temperature.
Figure 6:
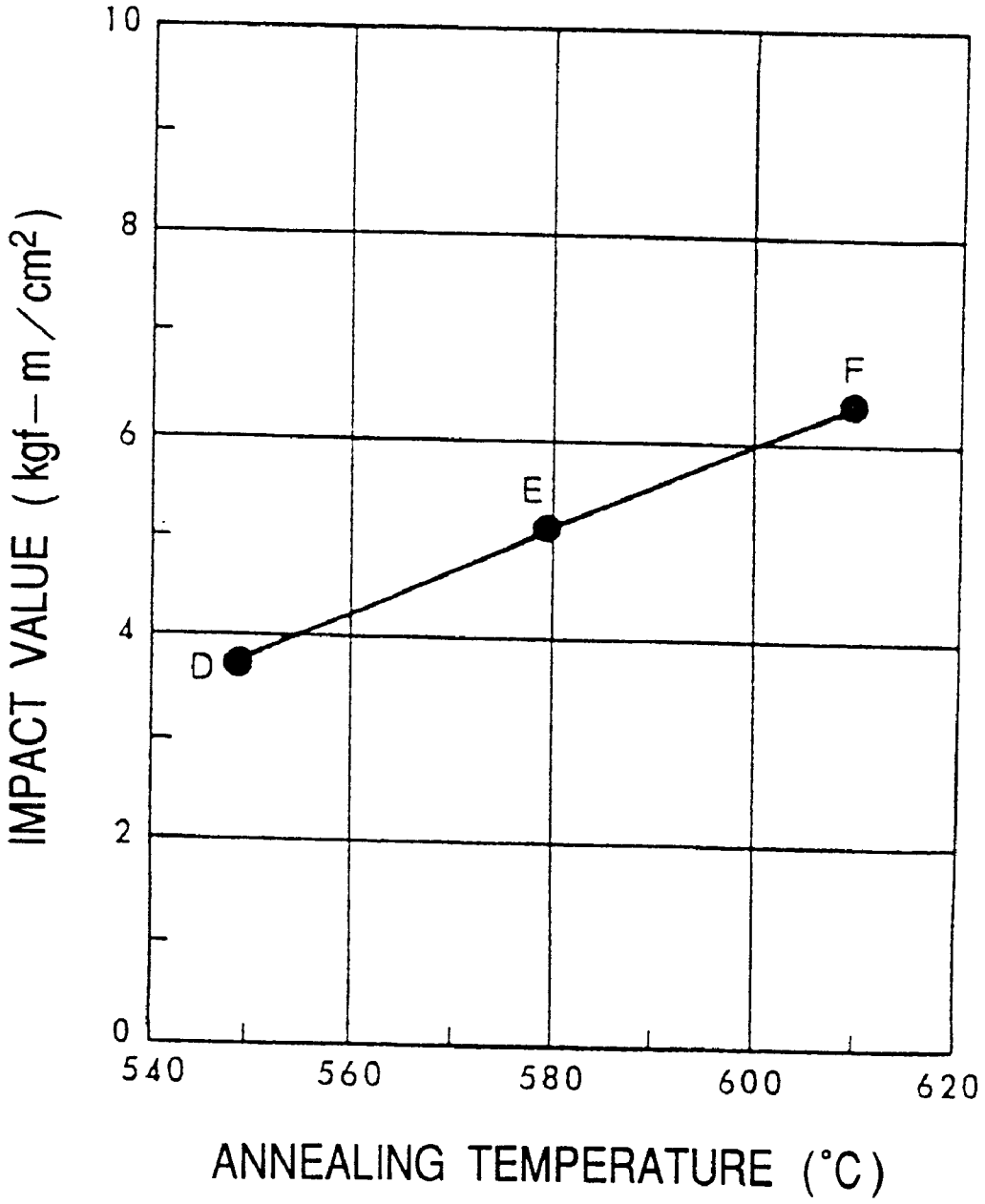
FIG. 6 is a diagram showing a relationship between an impact value and a temper temperature.

FIGS. 4 to 6 are diagrams showing dependences of heat-treatment conditions (quenching temperature and secondary temper temperature) on the tensile strength and impact value for Sample No. 3. The quenching temperature is in a range of 975 to 1125° C., and the primary temper temperature is in a range of 550 to 560° C. and the secondary temper temperature is in a range of 560 to 590° C. From the results shown in the figures, it is confirmed that Sample No. 3, which is heat-treated in the above heat-treatment conditions, satisfies characteristics required as a long blade material (tensile strength≧128.5 kgf/mm$^2$, Charpy V-notch impact value (at 20° C.)≧4 kgf-m/cm$^2$). In addition, the secondary temper temperature in FIGS. 3 and 5 is 575° C., and the quenching temperature in each of FIGS. 4 and 6 is 1050° C.

Figure 7:
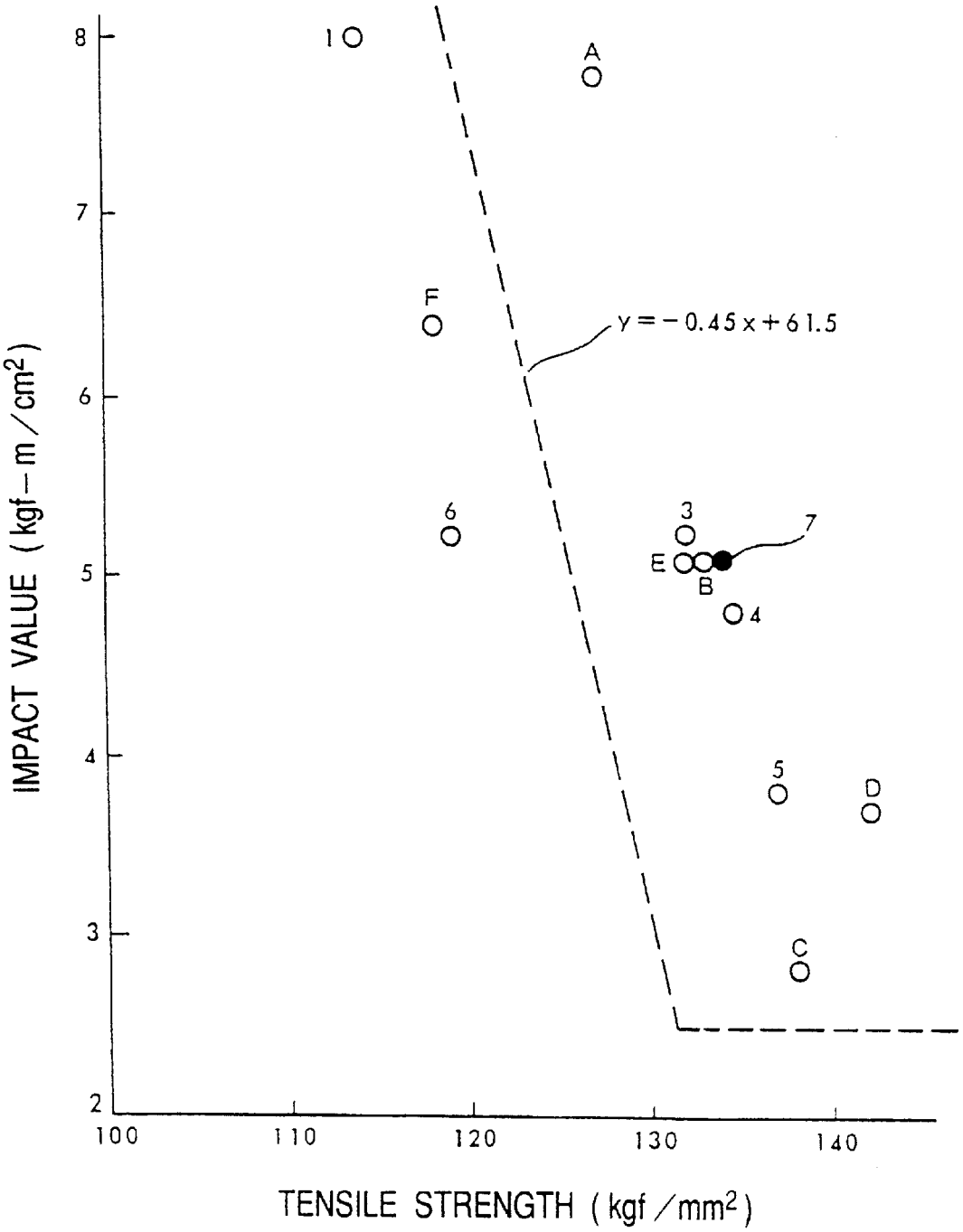
FIG. 7 is a diagram showing a relationship between an impact value and a tensile strength.

FIG. 7 is a diagram showing a relationship between a tensile strength and an impact value. The 12% Cr based steel in this embodiment is, as described above, preferred to exhibit a tensile strength of 120 kgf/mm$^2$ or more and an impact value of 4 kgf-m/cm$^2$ or more, and is more preferred to exhibit an impact value (y) which is not less than a value obtained by an equation of [−0.45×(tensile strength)+61.5].

The 12% Cr based steel according to the present invention is preferred to have such a composition that the (C+Nb) amount is in a range of 0.18 to 0.35%; the (Nb/C) ratio is in a range of 0.45 to 1.00; and the (Nb/N) ratio is in a range of 0.8 to 3.0.

Embodiment 2

With a sudden rise in cost of fuel after oil crisis as a turning-point, a boiler of a type of direct combustion of pulverized coal at a steam temperature of 600 to 649° C. and a steam turbine have been required to be used for the purpose of improving a thermal efficiency by setting high the steam conditions. One example of the boiler used under such high steam conditions is shown in Table 3.

TABLE 3

| | | |
|---|---|---|
| Plant output | | 1050 MW |
| Operating type | | Constant pressure type |
| Specification of boiler | Type | Radiative reheat type ultrasuper critical pressure once-through boiler |
| | Amount of evaporation | 3170 t/h |
| | Steam pressure | 24.12 Mpa [G] |
| | Steam temperature | 630° C./630° C. |

TABLE 3-continued

| | | |
|---|---|---|
| Plant output<br>Operating type | | 1050 MW<br>Constant pressure type |
| Perform-ance | Combustion characteristic NOx | 120 ppm |
| | Unburned com-bustible in ash | 3.2% |
| | Rate of change in load (50 ⟷ 100%) | 4%/min |
| | Minimum load | 33% ECR (Wet bank coal) |

With the increased plant output, the size of a pulverized coal combustion furnace is enlarged. For example, for a plant output of 1050 MW class, the furnace has a width of 31 m and a depth of 16 m; and for a plant output of 1400 MW class, the furnace has a width of 34 m and a depth of 18 m.

Table 4 shows a main specification of a steam turbine in which the steam temperature is set at 625° C. and the plant output is set at 1050 MW. The steam turbine in this embodiment is of a cross compound/quadruple-flow exhaust type. In this steam turbine, the length of a final stage blade in a low pressure turbine is 43 inches. A turbine configuration A has a turbine combination of [(HP-IP)+2×LP] and is operated at the number of revolution of 3000 rpm, and a turbine configuration B has a turbine combination of [(HP-LP)+(IP-LP)] and is operated at the number of revolution of 3000 rpm. Main components in the high pressure portion are made from materials shown in Table 4. In the high temperature portion (HP), the steam temperature is 625° C. and the steam pressure is 250 kgf/cm$^2$. The steam supplied from the HP portion is heated to 625° C. by a re-heater and is supplied to the intermediate pressure portion (IP). The intermediate pressure portion is operated at the steam temperature 625° C. and at a steam pressure of 45 to 65 kgf/cm$^2$. The steam at a steam temperature of 400° C. is supplied in the low pressure portion (LP), and the steam at a steam temperature of 100° C. or less and in a vacuum of 722 mm Hg is supplied to a steam condenser.

TABLE 4

| | | |
|---|---|---|
| Type of turbine | | CC4F-43 |
| Number of revolution | | 3000/3000 RPM |
| Steam condition | | 24.1 Mpa-625° C./625° C. |
| Configuration of turbine | A | 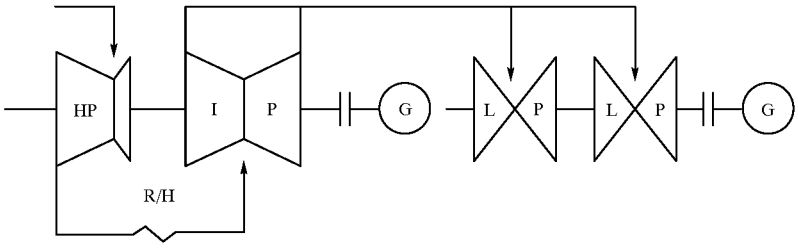 |
| | B | 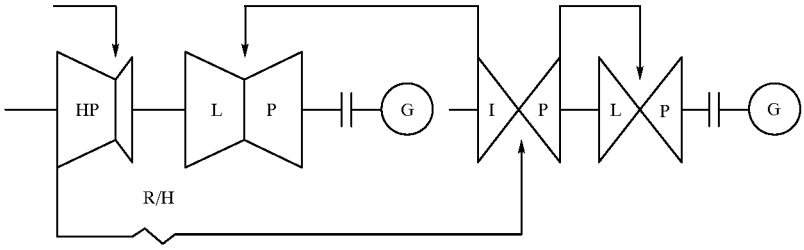 |
| Structure of first stage blade | | Double flow type,<br>2 tenon saddle type dovetail blade |
| Final stage blade | | High-strength 12Cr forged steel |
| Main steam stop valve body, Steam governor valve body | | High-strength 12Cr forged steel |
| High pressure rotor | | High-strength 12Cr forged steel |
| Intermediate pressure rotor | | High-strength 12Cr forged steel |
| Low pressure rotor | | 3.5 Ni-Cr-Mo-V forged steel |
| Rotating blade at high temperature portion | | First stage:<br>high-strength 12Cr forged steel |
| High pressure casing | Interior | High-strength 9Cr cast steel |
| | Exterior | High-strength Cr-Mo-V-B cast steel |
| Intermediate pressure casing | Interior | High-strength 9Cr cast steel |
| | Exterior | High-strength Cr-Mo-V-B cast steel |
| Gross thermal efficiency (Rated output, end of generator) | | 47.1% |

(CC4F-43: cross compound type quadruple-flow exhaust, 43 inch long blade
HP: high pressure portion, IP: intermediate pressure portion,
LP: low pressure portion, R/H: reheater (boiler))

Figure 8:
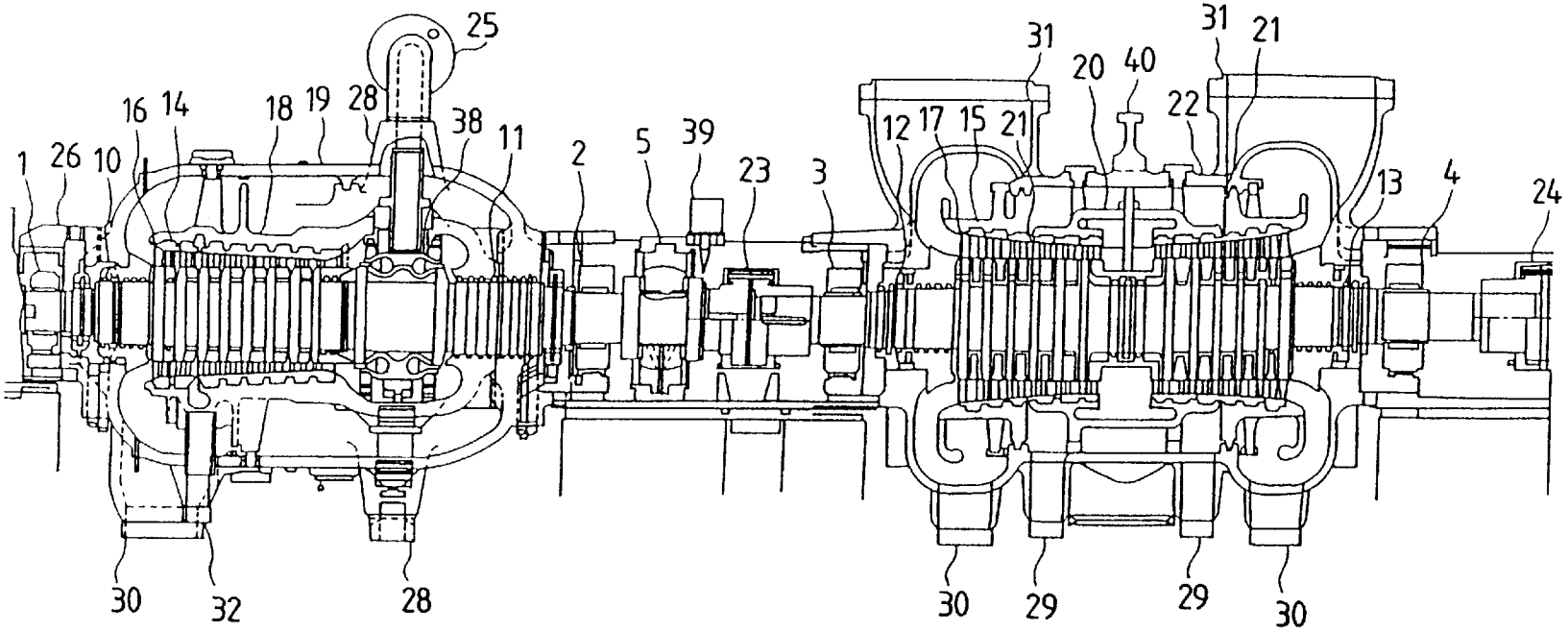
FIG. 8 is a sectional view of a high pressure steam turbine and an intermediate pressure steam turbine, which are connected to each other, according to the present invention.

FIG. 8 is a sectional configuration view showing the high pressure steam turbine and the intermediate pressure steam turbine of the turbine configuration A shown in Table 4. The high pressure steam turbine has a high pressure axle (high pressure rotor shaft) 23 which is disposed inside a high pressure inner casing 18 and a high pressure outer casing 19 positioned outside the inner casing 19. High pressure rotating blades 16 are planted in the high pressure rotor shaft 23. The above steam at a high temperature and a high pressure is produced by the above boiler, passing through a main steam pipe, a flange constituting a main steam inlet portion and an elbow 25, a main steam inlet 28, and is introduced to a first stage double-flow rotating blade from a nozzle box 38. Eight stages of rotating blades are provided on one side of the high pressure steam turbine, and stationary blades are provided in such a manner as to be matched with these rotating blades. The rotating blade is of a saddle-dovetail type having double tenons. The length of the first stage blade is about 35 mm. The distance between centers of bearing s i s about 5.8 m. The diameter of the minimum one of portions corresponding to the stationary blades is about 710 mm, and the ratio of the between-bearing distance to the diameter is about 8.2.

The axial root widths of rotating blade planted portions of the rotor shaft are specified such that the axial root width at the first stage is nearly equal to that of the final stage; and as for the axial root widths at the second to eighth stages, the axial root width becomes smaller toward the downstream side stepwise in five steps at the second stage, third to fifth stages, sixth stage, and seventh and eighth stages. The axial root width of the second stage rotating blade planted portion is 0.71 times that of the final stage rotating blade planted portion.

The diameter of a portion, of the rotor shaft, corresponding to the stationary blade is smaller than the diameter of the rotating blade planted portion of the rotor shaft. The axial root width of the portion, of the rotor shaft, corresponding to the stationary blade becomes smaller stepwise from that between the second stage and third stage rotating blades to that between the final stage rotating blade and the preceding one. The latter axial root width is 0.86 times smaller than the former axial root width. In some cases, the axial root width of the portion, of the rotor shaft, corresponding to the stationary blade becomes smaller stepwise in two steps at the second to sixth stages and sixth to ninth stages.

In this embodiment, all of the components other than the first stage blade and the nozzle are made from a 12% Cr based steel not containing W, Co and B. Each of the first stage blade and nozzle is made from a material shown in Table 5 (which will be described later). The length of a blade portion of the rotating blade in this embodiment is in a range of 35 to 50 mm at the first stage, and becomes longer in the direction from the second stage to the final stage. In particular, depending on the output of the steam turbine, each of the lengths of the blade portions of the second to final rotating blades is set in a range of 65 to 180 mm; the number of stages is set in a range of 9 to 12; and the length of the blade portion of the rotating blade on the downstream side becomes longer than that of the blade portion of the adjacent rotating blade on the upstream side at a ratio of 1.10 to 1.15, and the ratio becomes gradually larger toward the downstream side.

The intermediate pressure steam turbine is operated to rotate a generator together with the high pressure steam turbine by the steam which is discharged from the high pressure steam turbine and heated again at 625° C. by a reheater. The intermediate pressure steam turbine is rotated at 3000 rpm. The intermediate pressure turbine has intermediate pressure inner and outer casings 21 and 22 like the high pressure turbine. Stationary blades are provided correspondingly to intermediate pressure rotating blades 17. Two sets, each being composed of the rotating blades 17 of six stages (first stage: double-flow), are provided substantially symmetrically right and left in the longitudinal direction of an intermediate axle (intermediate pressure rotor shaft). The distance between centers of bearings is about 5.8 m. The length of the first stage blade is about 100 mm and the length of the final blade is about 230 mm. The dovetail of each of the first and second stage blades is formed into an inverse-chestnut shape. The diameter of a portion, of the rotor shaft, corresponding to the stationary blade positioned directly before the final stage rotating blade is about 630 mm, and the ratio of the between-bearing distance to this diameter is about 9.2.

In the intermediate pressure steam turbine in this embodiment, the axial root width of a rotating blade planted portion of the rotor shaft becomes larger stepwise in three steps in the order of the first to fourth stages, fifth stage, and final stage. The axial root width of the final stage rotating blade planted portion is about 1.4 times larger than that of the first stage rotating portion planted portion.

In this steam turbine, the diameters of portions, of the rotor shaft, corresponding to stationary blades are set to be small. The axial root width of the portion, of the rotor shaft, corresponding to the stationary blade becomes smaller stepwise in four steps in the order of the first stage, second and third stages, and final stage. The axial root width at the latter stage becomes smaller about 0.75 times than that at the latter stage.

In this embodiment , all of the components other than the first stage blade and the nozzle are made from a 12% Cr based steel not containing W, Co and B. Each of the first stage blade and nozzle is made from a material shown in Table 5 (which will be described later). The length of a blade portion of the rotating blade in this embodiment becomes longer in the direction from the first stage Lo the final stage. In particular, depending on the output of the steam turbine, each of the lengths of the blade portions of the first to final rotating blades is set in a range of 60 to 300 mm; the number of stages is set in a range of 6 to 9; and t he length of the blade portion of the rotating blade on the downstream side becomes longer than that of the b lade portion of the adjacent rotating blade on the upstream side at a ratio of 1.1 to 1.2.

The diameter of the rotating blade planted portion is larger than that of the portion corresponding to the stationary blade. The larger the length of blade portion of the rotating blade, the larger the width of the rotating blade planted portion. The ratio of the width of the rotating blade planted portion to the length of the blade portion of the rotating blade is in a range of 0.35 to 0.8 and it becomes smaller stepwise in the order from the first stage to the final stage.

Figure 9:
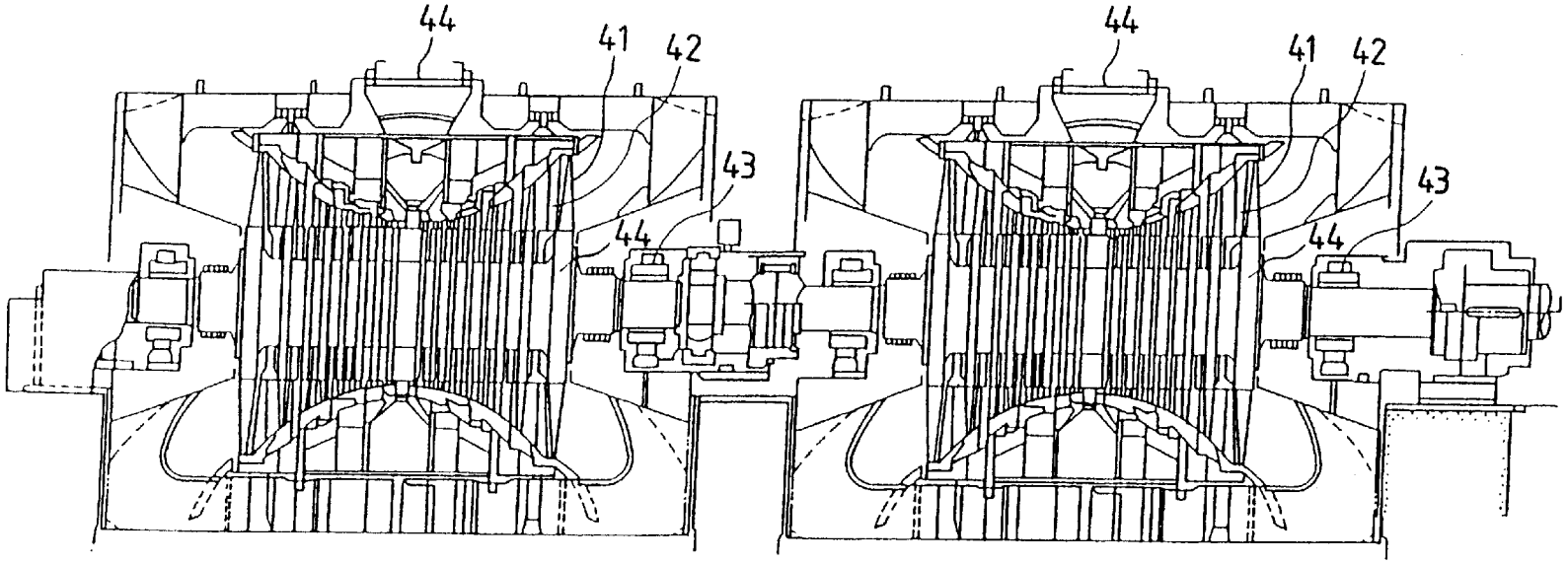
FIG. 9 is a sectional configuration view of a low pressure steam turbine according to the present invention.

FIG. 9 is a sectional view of two low pressure turbines in tandem with each other, whose structures are substantially identical to each other. Two sets, each being composed of rotating blades 41 of eight stages, are disposed substantially symmetrically right and left, and stationary blades 42 are provided correspondingly to the rotating blades 41. The final rotating blade has a length of 43 inches, and is made from the 12% Cr based steel corresponding to Sample No. 7 shown in Table 1. The final rotating blade is of a double tenon/saddle-dovetail type shown in FIG. 10, and a nozzle box 44 is of a double-flow type. A rotor shaft 43 is made from a super clean forged steel having a full temper bainite structure. To be more specific, the forged steel contains 3.75 wt % of Ni, 1.75 wt % of Cr, 0.4 wt % of Mo, 0.15 wt % of V, 0.25 wt % of C, 0.05 wt % of Si and 0.10 wt % of Mn, the balance being Fe. The rotating blades other than the final one and the stationary blades are made from a 12% Cr based steel containing 0.1 wt % of Mo. The inner and outer casings are made from a cast steel containing 0.25 wt % of C. In this embodiment, the distance between centers of bearings 43 is 7500 mm; the diameter of a portion, of the rotor shaft, corresponding to the stationary blade is about 1280 mm; and the diameter of a rotating blade planted portion of the rotor shaft is 2275 mm. The ratio of the between-bearing distance to the diameter of the portion, of the rotor shaft, corresponding to the stationary blade is about 5.9.

Figure 10:
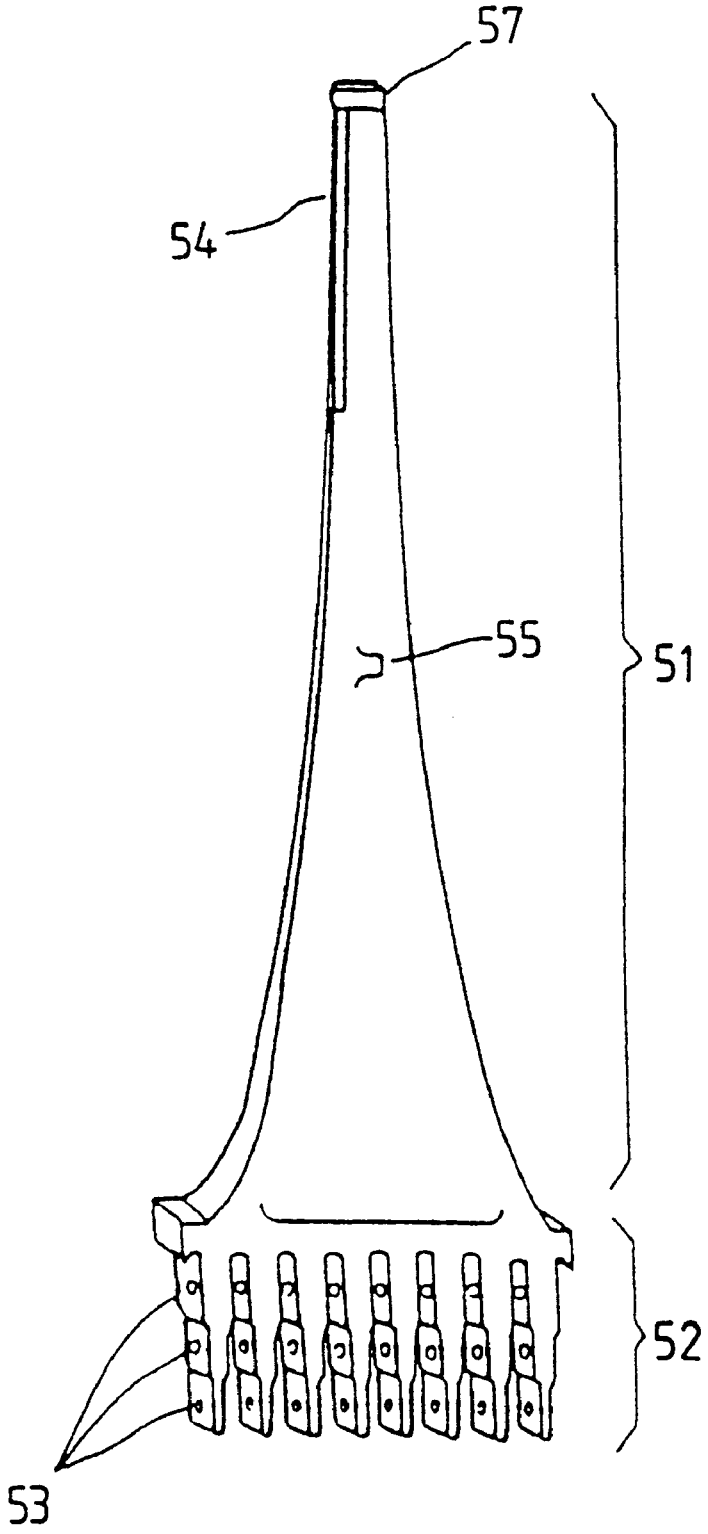
FIG. 10 is a perspective view of a turbine rotating blade according to the present invention.

FIG. 10 is a perspective view of a long blade of a size of 1092 mm (43"). Reference numeral 51 indicates a blade portion with which high speed steam collides; 52 is a portion to be planted in the rotor shaft; 53 is a hole into which a pin for supporting the blade applied with a centrifugal force is to be inserted; 54 is an erosion shield (plate made from stellite which is a Co-based alloy is joined by welding) for preventing erosion caused by water drop in steam; and 57 is a cover. In this embodiment, the long blade is formed by cutting a one-body forged part. It is to be noted that the cover 57 may be mechanically formed in a state being integral with the long blade.

The 43" long blade is produced by melting a material by an electrosiag re-melting process, followed by forging and heat-treatment. The forging was performed at a temperature in a range of 850 to 1150° C., and the heat-treatment was performed in the condition described in the first embodiment. Sample No. 7 in Table 1 shows a chemical composition (wt %) of the long blade material. The metal structure of the long blade material was a full temper martensite structure.

The tensile strength at room temperature and the Charpy V-notch impact value (at 20° C.) of Sample No. 7 are shown in Table 1. It is confirmed that the 43" long blade exhibits sufficient mechanical properties over the necessary characteristics, more specifically, a tensile strength of 128.5 $kgf/mm^2$ or more and a Charpy V-notch impact value (at 20° C.) of 4 $kgf\text{-}m/mm^2$ or more.

In the low pressure turbine in this embodiment, the axial root width of a rotating blade planted portion of the rotor shaft becomes gradually larger in four steps in the order of the first to third stages, fourth stage, fifth stage, sixth and seventh stages, and eighth stage. The axial root width of the final stage rotating blade planted portion becomes larger about 6.8 times than that of the first stage rotating blade planted portion.

The diameters of portions, of the rotor shaft, corresponding to stationary blades are small. The axial root width of the portion corresponding to the stationary blade becomes gradually larger in three steps in the order of fifth stage, sixth stage and seventh stage from the first stage rotating blade side. The axial root width of the portion corresponding to the stationary blade on the final stage side becomes larger about 2.5 times than that of the portion corresponding to the stationary blade between the first and second stage rotating blades.

In this embodiment, the number of the rotating blades is six. The length of the blade portion of the rotating blade becomes longer from about 3" at the first stage to 43" at the final stage. Depending on the output of the steam turbine, each of the lengths of the blade portions of the first to final rotating blades is set in a range of 80 to 1100 mm; the number of stages is 8 or 9; and the length of the blade portion of the rotating blade on the downstream side becomes longer than that of the blade portion of the adjacent rotating blade on the upstream side at a ratio of 1.2 to 1.8.

The diameter of the rotating blade planted portion is larger than that of the portion corresponding to the stationary blade. The larger the length of blade portion of the rotating blade, the larger the width of the rotating blade planted portion. The ratio of the width of the rotating blade planted portion to the length of the blade portion of the rotating blade is in a range of 0.15 to 0.91 and it becomes smaller stepwise in the order from the first stage to the final stage.

The axial root width of the portion, of the rotor shaft, corresponding to the stationary blade becomes smaller stepwise from that between the first stage and second stage rotating blades to that between the final stage rotating blade and the preceding one. The ratio of the axial root width of the portion, of the rotor shaft, corresponding to the stationary blade to the length of the blade portion of the rotating blade is in a range of 0.25 to 1.25 and it becomes smaller from the upstream side to the downstream side.

The configuration of this embodiment can be applied to a large capacity (1000 MW class) power-generation plant in which the temperature at a steam inlet to each of a high pressure steam turbine and an intermediate pressure steam turbine is set at 610° C. and the temperature at a steam inlet to each of two low pressure steam turbine is set at 385° C.

The high temperature/high pressure steam turbine plant in this embodiment mainly includes a coal burning boiler, a high pressure turbine, an intermediate pressure turbine, two low pressure turbines, a steam condenser, a condensate pump, a low pressure feed-water heater system, a deaerator, a booster pump, a feed-water pump, and a high pressure feed-water heater system. In this turbine plant, ultra-high temperature/high pressure steam generated by the boiler flows in the high pressure turbine to generate a power, being re-heated by the boiler, and flows in the intermediate pressure turbine to generate a power. The steam discharged from the intermediate pressure turbine flows in the low pressure turbine to generate a power, and is then condensed by the condenser. The condensed water is fed to the low pressure feed-water heater system and the deaerator by the condensate pump. The water deaerated by the deaerator is fed to the high pressure feed-water heater by the booster pump and the feed-water pump, being heated by the heater, and is then returned into the boiler.

In the boiler, the water is converted into high temperature/high pressure steam by way of an economizer, an evaporator, and a superheater. Meanwhile, the combustion gas in the boiler used for heating the steam flows out of the economizer, and enters an air heater. In addition, a turbine operated by bleed steam from the intermediate pressure turbine is used for driving the feed-water pump.

In the high temperature/high pressure steam turbine plant having the above configuration, since the temperature of the feed-water discharged from the high pressure feed-water heater system is very higher than the temperature of the feed-water in a conventional thermal power plant, the temperature of the combustion gas discharged from the economizer in the boiler becomes necessarily very higher than that in a conventional boiler. Accordingly, the heat of the exhaust gas of the boiler is recovered to lower the gas temperature.

The configuration of this embodiment can be applied to a tandem compound type power-generation plant in which a high pressure turbine, an intermediate pressure turbine, and one or two low pressure turbines are connected in tandem to each other to rotate one generator for power generation. In the generator having an output of 1050 MW class in this embodiment, a generator shaft is made from a material having a high strength. In particular, there is preferably used a material containing 0.15–0.30 wt % of C, 0.1–0.3 wt % of Si, 0.5 wt % or less of Mn, 3.25–4.5 wt % of Ni, 2.05–3.0 wt % of Cr, 0.25–0.60 wt % of Mo, and 0.05–0.20 wt % of V. This material has a full temper bainite structure and exhibits a tensile strength (at room temperature) of 93 kgf/mm$^2$ or more, preferably, 100 kgf/mm2 or more, a 50% FATT of 0° C. or less, preferably, −20° C. or less, and a magnetizing force (at 21.2 KG) of 985 AT/cm or less. In this material, further, the total amount of P, S, Sn, Sb and As as impurities is preferably set in a range of 0.025 wt % or less, and a Ni/Cr ratio is preferably set in a range of 2.0 or less.

The high pressure turbine shaft has a structure in which nine stages of blades are planted on each multi-stage side centered on a first stage blade planted portion. The intermediate pressure turbine shaft is provided with two sets, each being composed of six stages of blades, disposed substantially symmetrically right and left with respect to an approximately central portion of the turbine shaft. In addition, while the rotor shaft of the low pressure turbine is not shown in any figure, either of the rotor shafts of the high pressure, intermediate pressure and low pressure turbines has a center hole through which the material quality is checked by ultrasonic inspection, visual inspection and fluorescent penetrant inspection. The material quality of the rotor shaft may be checked from the outer surface side thereof by ultrasonic inspection. In this case, the above center hole may be not formed in the rotor shaft.

Table 5 shows chemical compositions (wt %) of materials used for main portions of the high pressure turbine, intermediate pressure turbine, and low pressure turbine. In this embodiment, the high temperature portions of the high pressure portion and the intermediate pressure portion are all made from materials having ferrite based crystal structures exhibiting a thermal expansion coefficient of about $12\times10^{-6}$/° C., there is no problem caused by a difference in thermal expansion coefficient.

The rotor shaft of each of the high pressure turbine and the intermediate pressure turbine was produced by melting 30 ton of a heat resisting cast steel material shown in Table 5 in an electric furnace, followed by deoxidation using carbon in vacuum, and cast in a metal mold. The resultant ingot was forged into an electrode bar, which was then melted from top to bottom by electroslag re-melting. Then, the ingot was forged into a rotor shape (diameter: 1050 mm, length: 3700 mm). The forging was performed at a temperature lower than 1150° C. for preventing occurrence of forging cracks. The forged steel product was then annealed, being heated at 1050° C. and quenched by water spray cooling, and tempered twice at 570° C. and 690° C. The product thus heat-treated was cut into a shape shown in FIGS. 5 and 6. In this embodiment, the upper side of the ingot formed into the rotor shape, obtained by electroslag re-melting, was taken as the first stage blade side and the lower side thereof was taken as the final stage blade side.

Each of the blade and nozzle used in the high pressure portion and the intermediate pressure portion was produced by melting a heat resisting steel material shown in Table 5 in a vacuum arc melting furnace and forging the ingot into a shape of each of the blade and nozzle (width: 150 mm, height: 50 mm, length: 1000 mm). The forging was performed at a temperature lower than 1150° C. for preventing occurrence of forging cracks. The forged steel product was then heated at 1050° C. and oil-quenched, being annealed at 690° C., and cut into a specific shape.

Each of the inner casing, main steam stop valve casing and steam governor valve casing in the high pressure portion and the intermediate pressure portion was produced by melting a heat resisting cast steel material shown in Table 5, followed by ladle refining, and casting the molten steel into a sand mold. Since refining and deoxidation were sufficiently performed before casting, any casting defect such as a shrinkage cavity was not found in the cast product. The weldability for the casing material thus obtained was evaluated in accordance with JIS Z3158. In the welding test for evaluation, each of the pre-heating temperature, interpass temperature and post-heating starting temperature was set at 200° C., and the past-heating treatment was performed under a condition of 400° C.×30 min. As a result of this evaluation test, any welding crack was not found in the inventive casting material. This means that the inventive casting material is desirable in weldability.

TABLE 5

(wt. %) psil-14

| Main parts | | C | Si | Mn | Ni | Cr | Mo | W | V | Nb | N | Co | B | Others | Cr equivalent | Remarks |
|---|---|---|---|---|---|---|---|---|---|---|---|---|---|---|---|---|
| High pressure portion and inter-mediate pressure portion | Rotor | 0.11 | 0.03 | 0.52 | 0.49 | 10.99 | 0.19 | 2.60 | 0.21 | 0.07 | 0.019 | 2.70 | 0.015 | — | 5.11 (≦9.5) | Forged steel |
| | Blade (first stage) | 0.10 | 0.04 | 0.47 | 0.51 | 11.01 | 0.15 | 2.62 | 0.19 | 0.08 | 0.020 | 2.81 | 0.016 | — | 5.07 (≦10) | Forged steel |
| | Nozzle (first stage) | 0.09 | 0.04 | 0.55 | 0.59 | 10.50 | 0.14 | 2.54 | 0.18 | 0.06 | 0.015 | 2.67 | 0.013 | — | 4.54 (≦10) | Forged steel |
| | Inner casing | 0.12 | 0.19 | 0.50 | 0.68 | 8.95 | 0.60 | 1.68 | 0.18 | 0.06 | 0.040 | — | 0.002 | — | 7.57 | Cast steel |
| | Outer casing | 0.12 | 0.21 | 0.32 | 0.08 | 1.51 | 1.22 | — | 0.22 | — | — | — | 0.0007 | Ti0.05 Al0.010 | — | Cast steel |
| | Inner casing fastening bolt | 0.11 | 0.10 | 0.50 | 0.60 | 10.82 | 0.23 | 2.80 | 0.23 | 0.08 | 0.021 | 3.00 | 0.020 | — | 4.72 | Forged steel |
| Low pressure portion | Rotor | 0.25 | 0.03 | 0.04 | 3.68 | 1.75 | 0.36 | — | 0.13 | — | — | — | — | — | — | Forged steel |
| | Blade | 0.11 | 0.20 | 0.53 | 0.39 | 12.07 | 0.07 | — | — | — | — | — | — | — | — | Forged steel |
| | Nozzle | 0.12 | 0.18 | 0.50 | 0.43 | 12.13 | 0.10 | — | — | — | — | — | — | — | — | Forged steel |
| | Inner casing | 0.25 | 0.51 | — | — | — | — | — | — | — | — | — | — | — | — | Cast steel |
| | Outer casing | 0.24 | 0.50 | — | — | — | — | — | — | — | — | — | — | — | — | Cast steel |
| Casing for main steam stop valve | | 0.10 | 0.19 | 0.48 | 0.65 | 8.96 | 0.60 | 1.62 | 0.20 | 0.05 | 0.042 | — | 0.002 | — | 8.56 | Cast steel |

TABLE 5-continued

| Main parts | C | Si | Mn | Ni | Cr | Mo | W | V | Nb | N | Co | B | Others | (wt. %) Cr equivalent | psil-14 Remarks |
|---|---|---|---|---|---|---|---|---|---|---|---|---|---|---|---|
| Casing for steam governor valve | 0.12 | 0.21 | 0.52 | 0.63 | 9.00 | 0.63 | 1.70 | 0.17 | 0.06 | 0.039 | — | 0.003 | — | 7.97 | Cast steel |

Table 6 shows results of examining mechanical properties of the main members cut off from the above ferrite based steel made high temperature steam turbine, and heat-treatment conditions.

As a result of examining mechanical properties of a central portion of the rotor shaft, it was confirmed that the mechanical properties of the central portion sufficiently satisfy characteristics ($10^5$ h creep rupture strength (at 625° C.)≧10 kgf/mm$^2$; impact absorption energy (at 20° C.)≧1.5 kgf-m) required for rotors of the high pressure and intermediate pressure turbines. This verifies that a steam turbine rotor usable in steam at a temperature of 620° C. or more can be produced.

As a result of examining mechanical properties of the blade, it was confirmed that the mechanical properties of the blade sufficiently satisfy characteristics ($10^5$ h creep rupture strength (at 625° C.)≧15 kgf/mm$^2$) required for first stage blades of the high pressure and intermediate pressure turbines. This verifies that a steam turbine blade usable in steam at a temperature of 620° C. or more can be produced.

As a result of examining mechanical properties of the casing, it was confirmed that the mechanical properties of the casing sufficiently satisfy characteristics ($10^5$ h creep rupture strength (at 625° C.)≧10 kgf/mm$^2$; impact absorption energy (at 20° C.)≧1 kgf-m) required for casings of the high pressure and intermediate pressure turbines and further the casing material is weldable. This verifies that a steam turbine casing usable in steam at a temperature of 620° C. or more can be produced.

TABLE 6

| Main parts | | Tensile strength (kgf/mm$^2$) | 0.2% proof stress (kgf/mm$^2$) | Elongation (%) | Reduction of area (%) | Impact value (kgf-m) | FATT (%) | $10^5$ h creep rupture strength (kgf/mm$^2$) 625 ° C. | 575 ° C. | 450 ° C. | pail-14 Heat treatment condition |
|---|---|---|---|---|---|---|---|---|---|---|---|
| High pressure portion and intermediate pressure portion | Rotor | 90.5 | 76.6 | 20.6 | 66.8 | 3.8 | 40 | 17.0 | — | — | 1050° C. × 15 h→water spray cooling, 570° C. × 20 h→furnace cooling, 690° C. × 20 h→furnace cooling |
| | Blade | 93.4 | 81.5 | 20.9 | 69.8 | 4.1 | — | 18.1 | — | — | 1075° C. × 1.5 h→oil cooling, 740° C. × 5 h→air cooling |
| | Nozzle | 93.0 | 80.9 | 21.4 | 70.3 | 4.8 | — | 17.8 | — | — | 1050° C. × 1.5 h→oil cooling, 690° C. × 5 h→air cooling |
| | Inner casing | 79.7 | 60.9 | 19.8 | 65.3 | 5.3 | — | 11.2 | — | — | 1050° C. × 8 h→air blast cooling, 600° C. × 20 h→furnace cooling, 730° C. × 10 h→furnace cooling |
| | Outer casing | 69.0 | 53.8 | 21.4 | 65.4 | 1.5 | — | — | 12.5 | — | 1050° C. × 8 h→air blast cooling, 725° C. × 10 h→furnace cooling |
| | Inner casing fastening bolt | 107.1 | 91.0 | 19.5 | 88.7 | 2.0 | — | 18.0 | — | — | 1075° C. × 2 h→oil cooling, 740° C. × 5 h→air cooling |
| Low pressure portion | Rotor | 91.8 | 80.0 | 22.0 | 70.1 | 19.1 | −50 | — | — | 36 | 950° C. × 30 h→water spray cooling, 605° C. × 45 h→furnace cooling |
| | Blade | 80.0 | 66.0 | 22.1 | 67.5 | 3.5 | — | — | — | 27 | 950° C. × 1.5 h→oil cooling, 605° C. × 5 h→air cooling |
| | Nozzle | 79.8 | 65.7 | 22.4 | 69.6 | 3.8 | — | — | — | 26 | 950° C. × 1.5 h→oil cooling, 605° C. × 1.5 h→air cooling |
| | Inner casing | 41.5 | 22.2 | 22.2 | 81.0 | — | — | — | — | — | — |
| | Outer casing | 41.1 | 20.3 | 24.5 | 80.5 | — | — | — | — | — | — |
| Casing for main steam stop valve | | 77.0 | 61.0 | 18.6 | 65.0 | 2.5 | — | 11.2 | — | — | 1050° C. × 8 h→air blast cooling, 600° C. × 20 h→furnace cooling, 730° C. × 10 h→furnace cooling |
| Casing for steam governor valve | | 77.5 | 61.6 | 18.2 | 64.8 | 2.4 | — | 11.0 | — | — | 1050° C. × 8 h→air blast cooling, 600° C. × 20 h→furnace cooling, 730° C. × 10 h→furnace cooling |

In this embodiment, a Cr—Mo low alloy steel was built up by welding on a journal portion of the rotor shaft for improving a bearing characteristic. The buildup welding is performed as follows:

As a test welding rod, there was used a coated electrode (diameter: 4.0Φ. The chemical composition (wt %) of a weld metal obtained by welding using the coated electrode is shown in Table 7. The composition of the weld metal is nearly equal to that of the welding material.

The welding condition is set such that the welding current is 170 A; the welding voltage is 24 V; and the welding speed is 26 cm/min.

TABLE 7

| No. | C | Si | Mn | P | S | Ni | Cr | Mo | Fe |
|---|---|---|---|---|---|---|---|---|---|
| A | 0.06 | 0.45 | 0.65 | 0.010 | 0.011 | — | 7.80 | 0.50 | Balance |
| B | 0.03 | 0.65 | 0.70 | 0.009 | 0.008 | — | 5.13 | 0.53 | " |
| C | 0.03 | 0.79 | 0.56 | 0.009 | 0.012 | 0.01 | 2.34 | 1.04 | " |
| D | 0.03 | 0.70 | 0.90 | 0.007 | 0.016 | 0.03 | 1.30 | 0.57 | " |

On the surface of the above-described test base material were built up eight layers using respective welding rods as shown in Table 8. The thickness of each layer was 3–4 mm, and the total thickness of the eight layers was about 28 mm. The surface portion of the buildup layers was ground about 5 mm.

The welding procedure conditions are set such that each of the pre-heating temperature, interpass temperature, and stress relief annealing (SR) starting temperature is in a range of 250 to 350° C., and the SR treatment is performed under a condition of 250 to 35 of 630° C.×36 h.

TABLE 8

| First layer | Second layer | Third layer | Fourth layer | Fifth layer | Sixth layer | Seventh layer | Eighth layer |
|---|---|---|---|---|---|---|---|
| A | B | C | D | E | F | G | H |

To check characteristics of the welded portion, the above buildup welding was repeated except for use of a plate as a base material. The weld portion of the plate was subjected to 160° side bending test, as a result of which any crack was not found in the welding portion.

The journal portion of the rotor shaft of the present invention was also subjected to bearing sliding test. As a result, it was confirmed that the journal portion did not exert any adverse effect on the bearing, and was also desirable in oxidation resistance.

The configuration of this embodiment can be applied to a tandem type power-generation plant in which a high pressure turbine, an intermediate pressure turbine, and one or two low pressure turbines are connected in tandem to be rotated at 3600 rpm, and further, the combination of the high pressure turbine, intermediate pressure turbine and low pressure turbine can be also applied to the turbine configuration B shown in Table 4.

Embodiment 3

Table 9 shows a main specification of a steam turbine in which the steam temperature is set at 600° C. and the plant output is set at 600 mw. In this embodiment, the steam turbine is of a tandem compound/double-flow type, and the length of a final stage blade in a low pressure turbine is 43 inches. A turbine configuration C has a turbine combination of [(HP/IP) integral type+LP] and a turbine configuration D has a turbine combination of [(HP/IP) integral type+2×LP], each of which is operated at the number of revolution of 3000 rpm. Main components in the high pressure portion are made from materials shown in Table 9. In the high temperature portion (HP), the steam temperature is 6000C and the steam pressure is 250 kgf/cm$^2$. The steam supplied from the HP portion is heated to 600° C. by a re-heater and is supplied to the intermediate pressure portion (IP). The intermediate pressure portion is operated at the steam temperature 600° C. and at a steam pressure of 45 to 65 kgf/cm$^2$. The steam at a steam temperature of 400° C. is supplied in the low pressure portion (LP), and the steam at a steam temperature of 100° C. or less and in a vacuum of 722 mm Hg is supplied to a steam condenser.

TABLE 9

| | | |
|---|---|---|
| Type of turbine | | TCDF-43 |
| Number of revolution | | 3000/3000 RPM |
| Steam condition | | 25 Mpa-600° C./600° C. |
| Configuration of turbine | C | 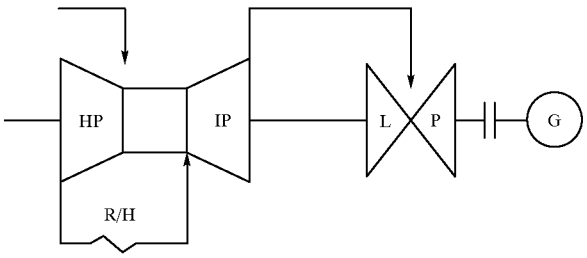 |
| | D | 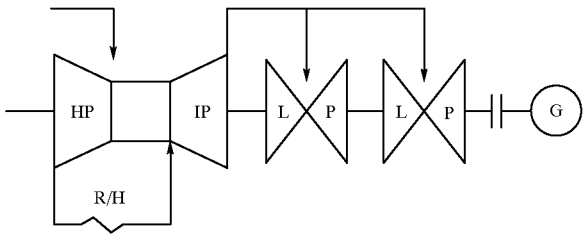 |

TABLE 9-continued

| | |
|---|---|
| Structure of first stage blade | 2 tenon saddle type dovetail blade |
| Final stage blade | Titanium alloy made 43 inch long blade or high-strength 12Cr forged steel |
| Main steam stop valve body, Steam governor valve body | High-strength 12Cr forged steel |
| High/intermediate pressure rotor | High-strength 12Cr forged steel |
| Low pressure rotor | 3.5 Ni-Cr-Mo-V forged steel |
| Rotating blade at high temperature portion | First stage: high-strength 12Cr forged steel |
| High/intermediate pressure casing Interior | High-strength 9Cr cast steel |
| Exterior | High-strength Cr-Mo-V-B cast steel |
| Gross thermal efficiency (Rated output, end of generator) | 47.1% |

(TCDF-43: tandem compound type double-flow exhaust, 43 inch long blade
HP: high pressure portion, IP: intermediate pressure portion,
LP: low pressure portion, R/H: reheater (boiler))

Figure 11:
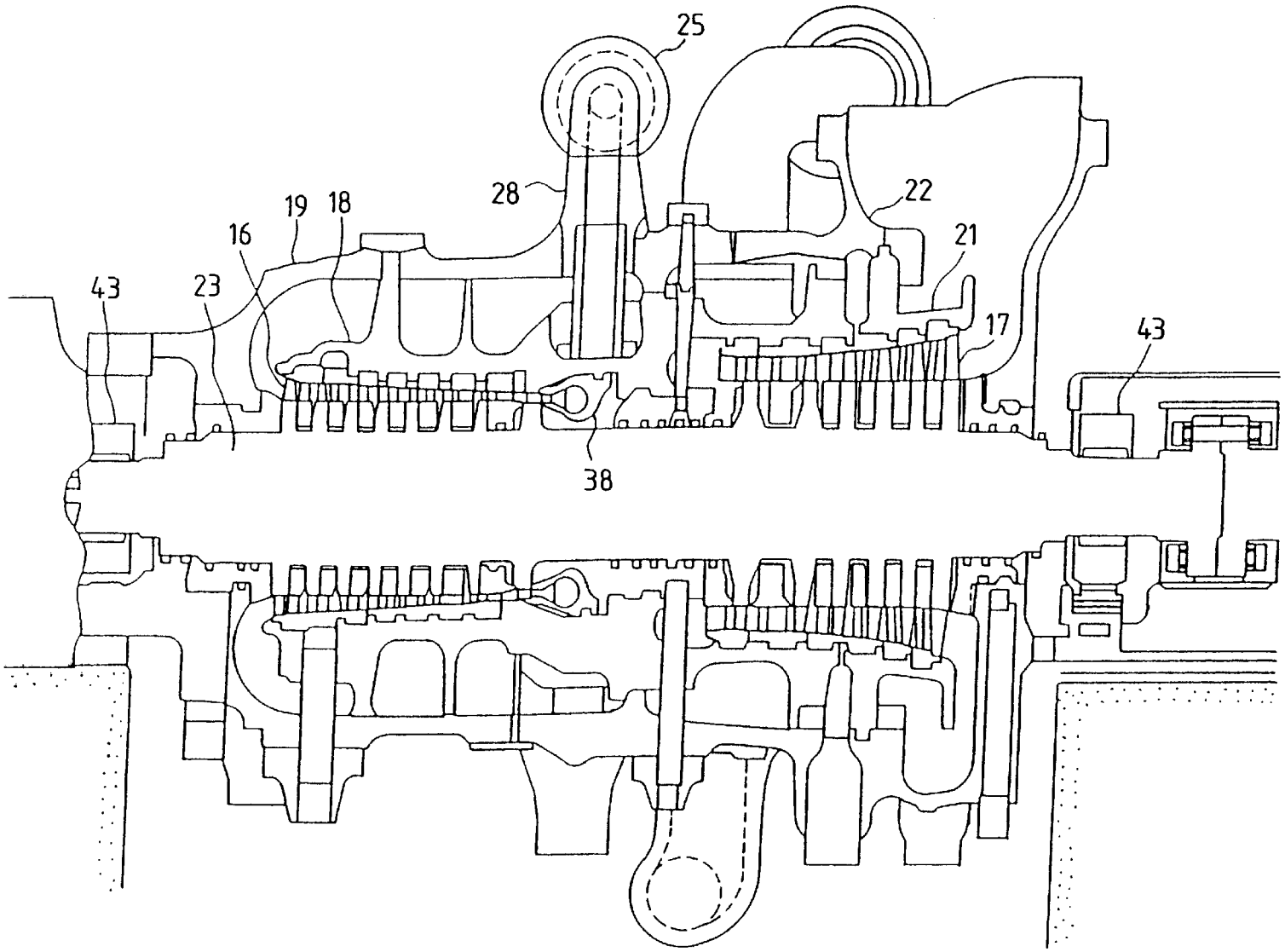
FIG. 11 is a sectional view of a high pressure/intermediate pressure steam turbine according to the present invention.
Figure 12:
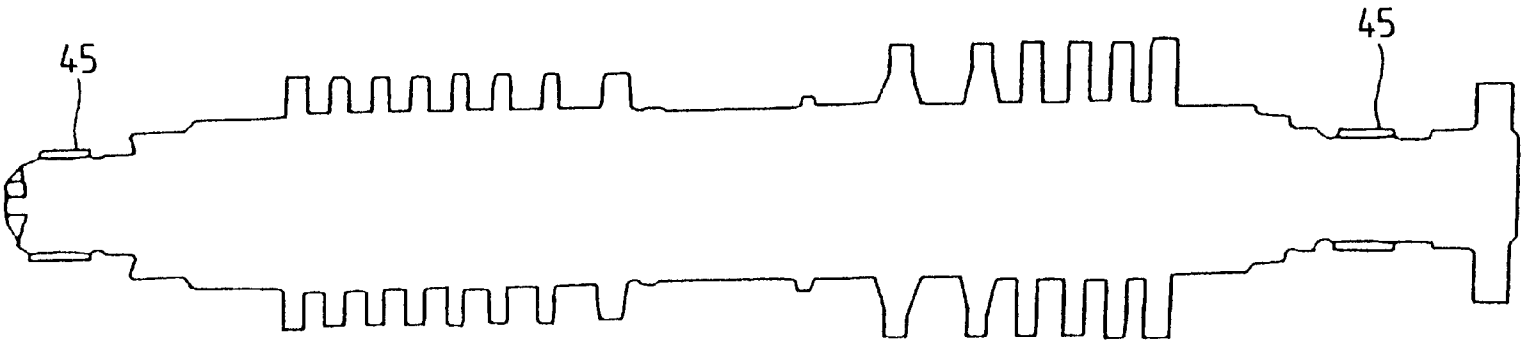
FIG. 12 is a sectional view of a rotor shaft for the high pressure/intermediate pressure steam turbine according to the present invention.

FIG. 11 is a sectional configuration view showing the high pressure side turbine-intermediate pressure side turbine integral type steam turbine, and FIG. 12 is a sectional view of a rotor shaft used in the steam turbine shown in FIG. 11. The high pressure side steam turbine has a high pressure/intermediate pressure axle (high pressure rotor shaft) 23 disposed inside an inner casing 18 and an outer casing 19 positioned outside the inner casing 18. High pressure side rotating blades 16 are planted in the high pressure rotor shaft 23. The above steam at a high temperature and a high pressure is produced by the above boiler, passing through a main steam pipe, a flange constituting a main steam inlet portion and an elbow 25, a main steam inlet 28, and is introduced to a first stage rotating blade from a nozzle box 38. Eight stages of rotating blades are provided on the high pressure side (left side in the figure), and six stages of rotating blades are provided on the intermediate pressure side (on the about half of the right side in the figure). Stationary blades are provided in such a manner as to be matched with these rotating blades. The rotating blade is of a saddle or "geta" (Japanese wooden sandal) shaped dovetail type having double tenons. The length of the first stage blade on the high pressure side is about 40 mm, and the length of the first stage blade on the intermediate pressure side is 100 mm. The distance between centers of bearings 43 is about 6.7 m. The diameter of the minimum one of portions corresponding to the stationary blades is about 740 mm, and the ratio of the between-bearing distance to this diameter is about 9.0.

As for the axial root widths of rotating blade planted portions of the high pressure side rotor shaft, the axial root width at the first stage is widest; the axial root widths at the second to seventh stages are substantially equal to each other, each of which is smaller 0.40–0.56 times than that at the first stage; and the axial root width at the final stage is intermediate between that at the first stage and that at each of the second to seventh stages, and which is smaller 0.46–0.62 times than that at the first stage.

The blade and nozzle on the high pressure side are made from a 12% Cr based steel shown in Table 5 (which will be described later). The length of a blade portion of the rotating blade in this embodiment is in a range of 35 to 50 mm at the first stage, and becomes longer in the direction from the second stage to the final stage. In particular, depending on the output of the steam turbine, each of the lengths of the blade portions of the second to final rotating blades is set in a range of 50 to 150 mm; the number of stages is set in a range of 7 to 12; and the length of the blade portion of the rotating blade on the downstream side becomes longer than that of the blade portion of the adjacent rotating blade on the upstream side at a ratio of 1.05 to 1.35, and the ratio becomes gradually larger toward the downstream side.

The intermediate pressure side steam turbine is operated to rotate a generator together with the high pressure side steam turbine by the steam which is discharged from the high pressure side steam turbine and heated again at 600° C. by a reheater. The intermediate pressure side steam turbine is rotated at 3000 rpm. The intermediate pressure side turbine has intermediate pressure inner and outer casings 21 and 22 like the high pressure side turbine. Stationary blades are provided correspondingly to intermediate pressure rotating blades 17. Six stages of the rotating blades 17 are provided. The length of the first stage blade is about 130 mm, and the length of the final stage blade is about 260 mm. The dovetail is formed into an inverse-chestnut shape. The diameter of a portion, of the rotor shaft, corresponding to the stationary blade is about 740 mm.

As for the axial root widths of rotating blade planted portions of the rotor shaft of the intermediate pressure steam turbine, the axial root width at the first stage is widest; the axial root width at the second stage is smaller than that at the first stage; the axial root widths at the third to fifth stages are equal to each other, each of which is smaller than that at the second stage; and the axial root width at the final stage is intermediate between that at the second stage and that at each of the third to fifth stages, and which is smaller 0.48–0.64 times than that at the first stage. The axial root width at the first stage is larger about 1.1–1.5 times than that at the second stage.

The blade and nozzle on the intermediate pressure side are made from a 12% Cr based steel shown in Table 5 (which will be described later). The length of a blade portion of the rotating blade in this embodiment becomes longer in the direction from the first stage to the final stage. In particular, depending on the output of the steam turbine, each of the lengths of the blade portions of the first to final rotating blades is set in a range of 90 to 350 mm; the number of stages is set in a range of 6 to 9; and the length of the blade portion of the rotating blade on the downstream side becomes longer than that of the blade portion of the adjacent rotating blade on the upstream side at a ratio of 1.10 to 1.25.

The diameter of the rotating blade planted portion is larger than that of the portion corresponding to the stationary blade. The width of the rotating blade planted portion is dependent on the length of the blade portion and the position of the rotating blade. The ratio of the width of the rotating blade planted portion to the length of the blade portion of the rotating blade is widest at the first stage (1.35 to 1.8 times), becomes slightly smaller at the second stage (0.88 to 1.18 times), and becomes gradually smaller toward the final stage at third to sixth stages (0.40 to 0.65 times).

Figure 13:
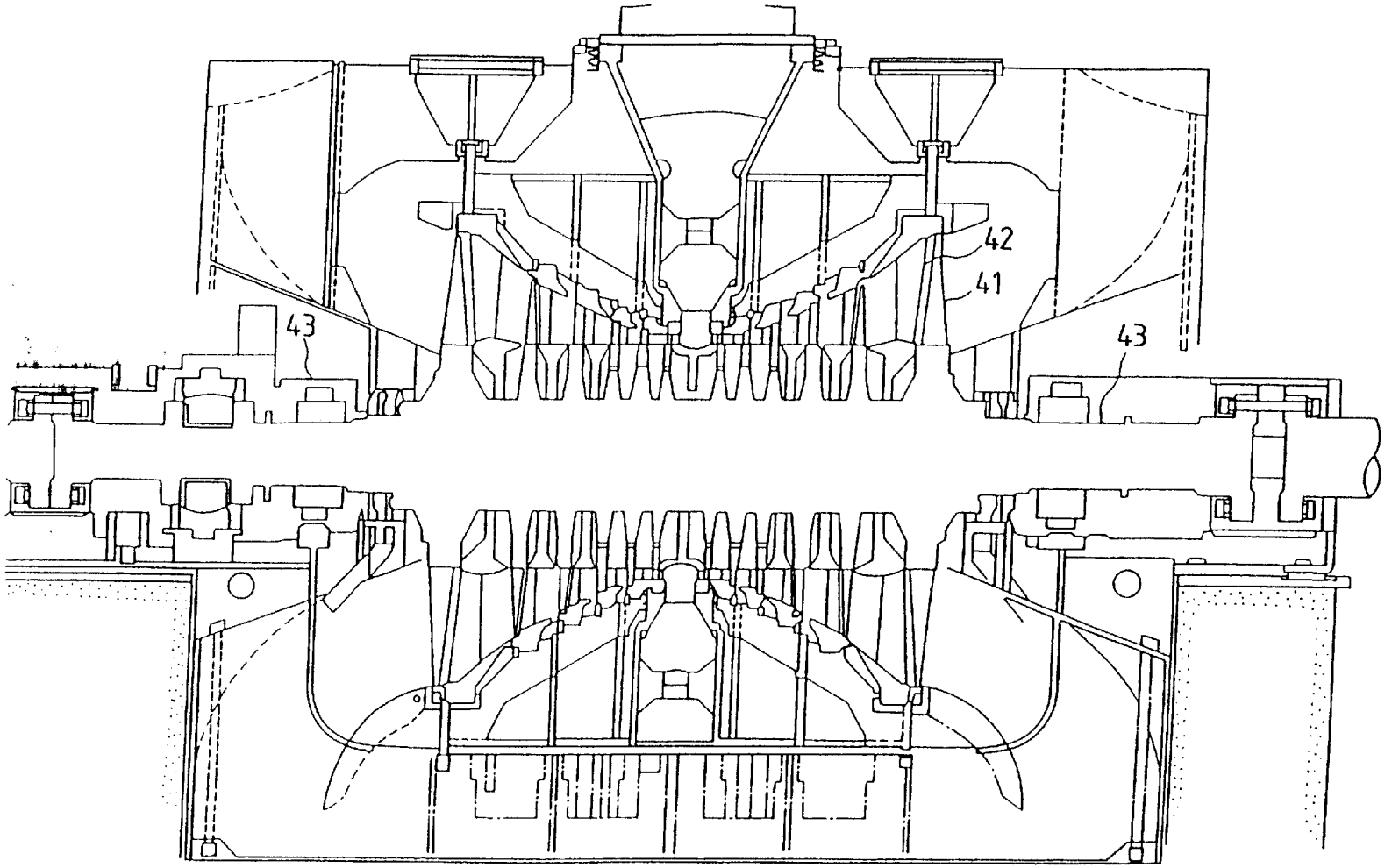
FIG. 13 is a sectional view of a low pressure steam turbine according to the present invention.
Figure 14:
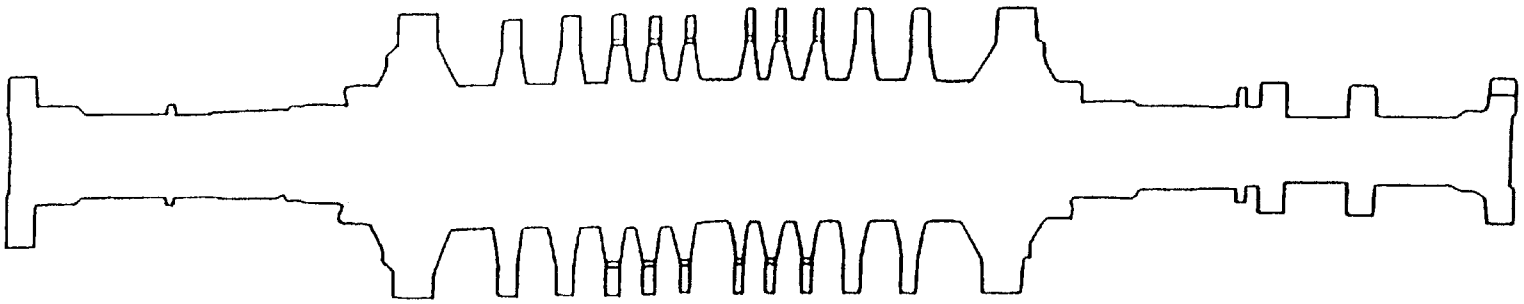
FIG. 14 is a sectional view of a rotor shaft for the low pressure steam turbine according to the present invention.

FIG. 13 is a sectional view of the low pressure turbine, and FIG. 14 is a sectional view of a rotor shaft of the low pressure turbine shown in FIG. 13. One low pressure turbine is connected in tandem with the high pressure/intermediate pressure sides. Two sets, each being composed of six stages of rotating blades 41, are disposed substantially symmetrically right and left. Stationary blades 42 are disposed in such a manner as to be matched with the rotating blades. The final stage rotating blade has a length of 43 inches, and is made from a 12% Cr based steel or a Ti based alloy shown in Table 1. The Ti based alloy contains 16 wt % of Al and 4 wt % of V and is subjected to age-hardening treatment. A rotor shaft 43 is made from a super clean forged steel having a full temper bainite structure. To be more specific, the forged steel contains 3.75 wt % of Ni, 1.75 wt % of Cr, 0.4 wt % of Mo, 0.15 wt % of V, 0.25 wt % of C, 0.05 wt % of Si and 0.10 wt % of Mn, the balance being Fe. The rotating blades other than the final state one and the preceding stage one and the stationary blades are made from a 12% Cr based steel containing 0.1 wt % of Mo. The inner and outer casings are made from a cast steel containing 0.25 wt % of C. In this embodiment, the distance between centers of bearings 43 is 7000 mm; the diameter of a portion, of the rotor shaft, corresponding to the stationary blade is about 800 mm. The diameter of the rotating blade planted portion of the rotor shaft is not changed at the first to final stages. The ratio of the between-bearing distance to the diameter of the portion, of the rotor shaft, corresponding to the stationary blade is about 8.8.

The axial root width of the rotating blade planted portion of the rotor shaft of the low pressure turbine is smallest at the first stage, and becomes gradually larger to the downstream side in four stages. The axial root width at the second stage is equal to that at the third stage, and the axial root width at the fourth stage is equal to that at the fifth stage. The axial root width at the final stage is larger 6.2–7.0 times than that at the first stage. The axial root width at each of the second and third stages is larger 1.15–1.40 times than that at the first stage; the axial root width at each of the fourth and fifth stages is larger 2.2–2.6 times than that at each of the second and third stages; and the axial root width at the final stage is larger 2.8–3.2 times than that at each of the fourth and fifth stages. In the figure, the width of a rotating blade planted portion is indicated by a distance between two points at which the downward extended lines of the rotating blade planted portion cross the diameter of the rotor shaft.

In this embodiment, the length of the blade portion of the rotating blade becomes longer from about 4" at the first stage to 43" at the final stage. Depending on the output of the steam turbine, each of the lengths of the blade portions of the first to final rotating blades is in a range of 100 to 1270 mm; the number of stages is 8 at maximum; and the length of the blade portion of the rotating blade on the downstream side becomes longer than that of the blade portion of the adjacent rotating blade on the upstream side at a ratio of 1.2 to 1.9.

As compared with the shape of the portion corresponding to the stationary blade, the shape of the rotating blade planted portion is extended downward. The larger the length of the blade portion of the rotating blade, the larger the width of the rotating blade planted portion. The ratio of the width of the rotating blade planted portion to the length of the blade portion of the rotating blade, which is in a range of 0.30 to 1.5, becomes gradually smaller from the first stage to the stage directly before the final stage. On the downstream side, the ratio at one stage becomes smaller 0.15–0.40 times than that at the preceding stage thereof. The ratio at the final stage is in a range of 0.50 to 0.65.

Figure 15:
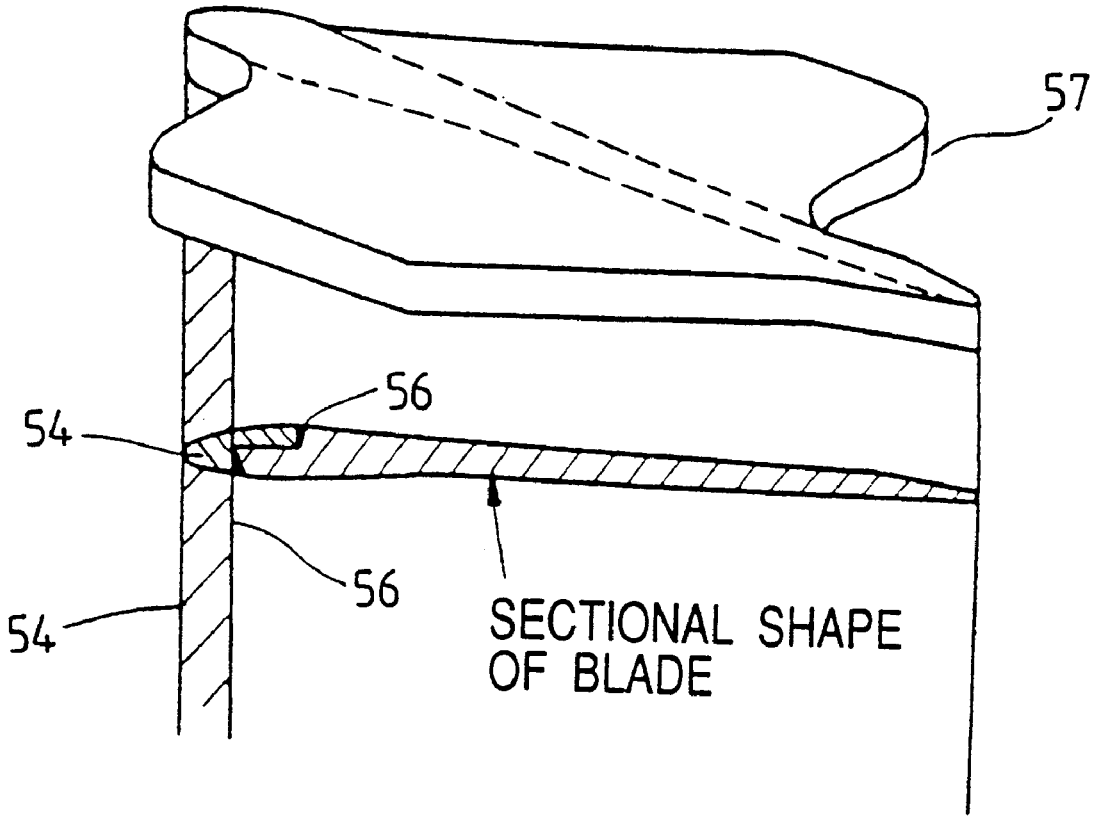
FIG. 15 is a perspective view of a leading end portion of a turbine rotating blade according to the present invention.

The final stage rotating blade in this embodiment is the same as that described in Embodiment 2. FIG. 15 is a perspective view, with an essential portion cutaway, showing a state in which an erosion shield (stellite alloy) 54 is joined by electron beam welding or TIG welding as indicated by reference numeral 56. As shown in the figure, the shield 54 is welded at two points on the front and back sides.

The configuration of this embodiment can be applied to a large capacity (1000 MW class) power-generation plant in which the temperature at a steam inlet to a high pressure/intermediate pressure steam turbine is 610° C. or more and temperatures of a steam inlet and a steam outlet to and from a low pressure steam turbine are about 400° C. and about 60° C. respectively.

The high temperature/high pressure steam turbine power-generation plant in this embodiment mainly includes a boiler, a high pressure/intermediate pressure turbine, a low pressure turbine, a steam condenser, a condensate pump, a low pressure feed-water heater system, a deaerator, a booster pump, a feed-water pump, and a high pressure feed-water heater system. Ultra-high temperature/high pressure steam generated by the boiler flows in the high pressure side turbine to generate a power, being re-heated by the boiler, and flows in the intermediate pressure side turbine to generate a power. The steam discharged from the high pressure/intermediate pressure turbine flows in the low pressure turbine to generate a power, and is then condensed by the condenser. The condensed water is fed to the low pressure feed-water heater system and the deaerator by the condensate pump. The water deaerated by the deaerator is fed to the high pressure feed-water heater by the booster pump and the feed-water pump, being heated by the heater, and is then returned into the boiler.

In the boiler, the water is converted into high temperature/high pressure steam by way of an economizer, an evaporator, and a superheater. Meanwhile, the combustion gas in the boiler used for heating the steam flows out of the economizer, and enters an air heater. In addition, a turbine operated by bleed steam from the intermediate pressure turbine is used for driving the feed-water pump.

In the high temperature/high pressure steam turbine plant having the above configuration, since the temperature at the feed-water discharged from the high pressure feed-water heater system is very higher than the temperature of the feed-water in a conventional thermal power plant, the temperature of the combustion gas discharged from the economizer in the boiler becomes necessarily very higher than that in a conventional boiler. Accordingly, the heat of the exhaust gas of the boiler is recovered to lower the gas temperature.

Although in this embodiment, the present invention is applied to the tandem compound/double flow type power-generation plant in which one high pressure/intermediate pressure turbine and one low pressure turbine are connected in tandem with one generator, the present invention can be also applied to the turbine configuration D having a large output of 1050 MW class, shown in Table 9, which is characterized in that two low pressure turbines are connected in tandem with each other. In the generator having an output of 1050 MW class, a generator shaft is made from a material having a high strength. In particular, there is preferably used a material containing 0.15–0.30 wt % of C, 0.1–0.3 wt % of Si, 0.5 wt % or less of Mn, 3.25–4.5 wt % wt % of Ni, 2.05–3.0 wt % of Cr, 0.25–0.60 wt % of Mo, and 0.05–0.20 wt % of V. This material has a full temper bainite structure and exhibits a tensile 0.05–0.20 wt % of V. This strength (at room temperature) of 93 kgf/mm$^2$ or more, preferably, 100 kgf/mm$^2$ or more, a 50% FATT of 0° C. or less, preferably, −20° C. or less, and a magnetizing force (at 21.2 KG) of 985 AT/cm or less. In this material, further, the total amount of P, S, Sn, Sb and As as impurities is preferably set in a range of 0.025 wt % or less, and a Ni/Cr ratio is preferably set in a range of 2.0 or less.

Table 5 (described above) shows chemical compositions (wt %) of materials used for main portions of the high pressure/intermediate pressure turbine and the low pressure turbine. In this embodiment, the main portions are all made from materials, shown in Table 5, having ferrite based crystal structures exhibiting a thermal expansion coefficient of about $12\times10^{-6}$/° C. except that the high temperature portion at which the high pressure side is integrated with the intermediate pressure side is made from a martensite steel represented by Sample No. 9 in Embodiment 4 to be described later, there is no problem caused by a difference in thermal expansion coefficient.

The rotor shaft of the high pressure/intermediate pressure portion was produced by melting 30 ton of a heat resisting cast steel material represented by Sample No. 1 in Table 10 in an electric furnace, followed by deoxidation using carbon in vacuum, and cast in a metal mold. The resultant ingot was forged into an electrode bar, which was then melted from top to bottom by electroslag re-melting. Then, the ingot was forged into a rotor shape (diameter: 1450 mm, length: 5000 mm). The forging was performed at a temperature lower than 1150° C. for preventing occurrence of forging cracks. The forged steel product was then annealed, being heated at 1050° C. and quenched by water spray cooling, and tempered twice at 570° C. and 690° C. The product thus heat-treated was cut into a shape shown in FIG. 12. Materials of other portions and producing conditions thereof are the same as those in Embodiment 2. Further, a bearing journal portion 45 was subjected to buildup welding in the same manner as that in Embodiment 2.

Embodiment 4

In this embodiment, each of alloys having compositions shown in Table 10 was melted in vacuum and cast into an ingot of 10 kg. The ingot was then forged into a shape of 30 mm×30 mm. For produced of a large-sized steam turbine shaft and a blade thereof, the forged product was subjected to the following heat-treatments under conditions determined by simulation of an actual operating condition of the central portion of the rotor shaft. For the rotor shaft, the forged product was kept at 1050° C. for 5 h and quenched by cooling at a cooling rate of 100° C./h (at the center portion). The quenched product was then subjected to primary temper under a condition of 570° C.×20 h and secondary temper under a condition of 690° C.×20 h. For the blade, the forged product was kept at 1100° C. for 1 h, followed by quenching, and was subjected to temper under a condition of 750° C.×1 h. Each of the resultant products for the rotor shaft and the blade was subjected to creep rupture test under a condition of 6250° C.–30 kgf/mm$^2$. The results are shown in Table 7.

The inventive alloys, represented by Sample Nos. 1 to 6 in Table 10 are proved to be long in creep rupture life and thereby desired to be used in a steam condition having a steam temperature of 620° C. or more. Although an increase in Co content prolongs the creep rupture time, a product made from the alloy containing Co in an excessively large amount tends to cause embrittlement when heated at a temperature of 600 to 660° C. To improve both the strength and toughness of a product made from the alloy containing Co, the alloy preferably contains Co in an amount of 2 to 5 wt % for the product used at a temperature of 620 to 630° C., and it preferably contains Co in an amount of 5.5 to 8 wt % for the product used at a temperature of 630 to 660° C. The element B exhibits a strength increasing effect in the case where the B content is in a range of 0.03 wt % or less. The alloy, which is adopted as a material of a product used in a temperature range of 620 to 630° C., preferably contains B in an amount of 0.001 to 0.01 wt % and Co in an amount of 2 to 4 wt % for increasing the strength of the product; and the alloy, which is adopted as a material of a product used on the higher temperature side, specifically, in a temperature range of 630 to 660° C., preferably contains B in an amount of 0.01 to 0.03 wt % and Co in an amount of 5 to 7.5 wt % for increasing the strength of the product.

As for the content of N, it became apparent that the alloy containing N in a smaller amount exhibits a strength higher than that of the alloy containing N in a larger amount, when the alloy is used at a temperature of 600° C. or more as in this embodiment. The N content is preferably in a range of 0.01 to 0.04 wt %. The element N is little contained in the alloy upon vacuum-melting, and therefore, it is added in the form of a mother alloy.

As shown in Table 10, the rotor material is equivalent to Sample No. 2 prepared in this embodiment, which exhibits a high strength. Sample No. 8 in which the Mn content is as low as 0.09% exhibits a higher strength as compared with a different sample, shown in Table 10, containing the same Co content as that of Sample No. 8, and therefore, to increase the strength of the alloy, the alloy preferably contains Mn in an amount of 0.03 to 0.20 wt %.

TABLE 10

| | Chemical composition (wt %) | | | | | | | | | | | | | Creep rapture strength (h) 625° C.-30 kgf/mm$^2$ | |
|---|---|---|---|---|---|---|---|---|---|---|---|---|---|---|---|
| | | | | | | | | | | | | | | Rotor | |
| No. | C | Si | Mn | Ni | Cr | Mo | W | V | Nb | Co | N | B | Fe | shaft | Blade |
| 1 | 0.11 | 0.01 | 0.50 | 0.54 | 10.72 | 0.15 | 2.61 | 0.20 | 0.09 | 2.15 | 0.025 | 0.014 | Bal | 140 | 278 |
| 2 | 0.11 | 0.01 | 0.50 | 0.50 | 10.98 | 0.15 | 2.59 | 0.21 | 0.09 | 2.87 | 0.025 | 0.014 | " | 161 | 315 |
| 3 | 0.11 | 0.01 | 0.51 | 0.53 | 11.00 | 0.16 | 2.55 | 0.22 | 0.08 | 5.79 | 0.027 | 0.015 | " | 241 | 508 |
| 4 | 0.11 | 0.01 | 0.48 | 0.49 | 11.03 | 0.18 | 2.60 | 0.19 | 0.08 | 9.43 | 0.030 | 0.016 | " | 240 | 488 |

TABLE 10-continued

| | Chemical composition (wt %) | | | | | | | | | | | | | Creep rapture strength (h) 625° C.-30 kgf/mm$^2$ Rotor | |
|---|---|---|---|---|---|---|---|---|---|---|---|---|---|---|---|
| No. | C | Si | Mn | Ni | Cr | Mo | W | V | Nb | Co | N | B | Fe | shaft | Blade |
| 5 | 0.12 | 0.01 | 1.30 | 0.11 | 11.24 | 0.20 | 2.65 | 0.18 | 0.11 | 2.98 | 0.051 | 0.003 | " | 192 | 392 |
| 6 | 0.13 | 0.01 | 0.15 | 0.89 | 11.35 | 0.09 | 2.91 | 0.27 | 0.10 | 4.50 | 0.045 | 0.027 | " | 219 | 456 |

Table 11 shows chemical compositions (wt %) of materials for rotor shafts suitable to be used at a temperature condition of a 600° C. class. The heat-treatment was performed by keeping the sample at 1100° C. for 2 h and cooling it at a cooling rate of 100° C./h; and heating the sample at 565° C. for 15 h and cooling it at a cooling rate of 20° C./h and heating again the sample at 665° C. for 45 h and cooling it at a cooling rate of 20° C./h. In this heat-treatment, each rotor shaft material was turned around its rotating shaft.

Table 12 shows mechanical properties of the rotor shaft materials. The impact value is represented by the Charpy V-notch value, and the FATT is represented by the 50% fracture appearance transition temperature.

TABLE 11

| No. | C | Si | Mn | Ni | Cr | Mo | V | Nb | N | W | Al | Cr equivalent |
|---|---|---|---|---|---|---|---|---|---|---|---|---|
| 7 | 0.17 | 0.21 | 0.57 | 0.60 | 11.15 | 1.29 | 0.22 | 0.07 | 0.049 | 0.24 | 0.007 | 8.89 |
| 8 | 0.18 | 0.24 | 0.60 | 0.59 | 11.20 | 1.24 | 0.19 | 0.06 | 0.048 | 0.41 | 0.019 | 8.41 |
| 9 | 0.17 | 0.22 | 0.57 | 0.60 | 11.10 | 1.24 | 0.21 | 0.06 | 0.045 | 0.49 | 0.015 | 9.04 |

TABLE 12

| No. | Tensile strength (kgf/mm$^2$) | Elongation (%) | Reduction area (%) | Impact value (kgf-m) | FATT (° C.) | 600° C., $10^5$h creep rapture strength (kgf/mm$^2$) |
|---|---|---|---|---|---|---|
| 7 | 90.5 | 20.1 | 60.0 | 2.05 | 49 | 11.6 |
| 8 | 90.4 | 20.0 | 58.1 | 1.97 | 52 | 10.8 |
| 9 | 91.0 | 19.5 | 58.3 | 2.00 | 56 | 11.7 |

As shown in Table 12, each of the inventive materials exhibits a 10- h creep rupture strength (at 600° C.) of 11 kgf/mm$^2$, and also exhibits a strength higher than a value (10 kgf/mm$^2$) required as a high efficient turbine material and a toughness higher than a value (1 kgf-m) required as the high efficient turbine material.

Sample No. 8, which contains Al in an amount more than 0.015 wt %, is slightly reduced in strength, concretely, it exhibits a $10^5$ h creep rupture strength less than 11 kgf/mm$^2$. It was confirmed that when the content of W in the alloy is increased up to about 1.0 wt %, there occurs precipitation of δ ferrite, leading to reduction in both the strength and toughness of the alloy. Accordingly, the W content increased up to about 1.0 wt % fails to achieve the object of the present invention.

The W content in an amount of 0.1 to 0.65 wt % is effective to increase the strength of the alloy.

As for the effect of the W content on the FATT, the FATT is low, that is, the toughness is high with the W content kept in a range of 0.1 to 0.65 wt %; however, the toughness becomes lower with the W content offset from the above range. The W content in a range of 0.2 to 0.5 wt % is particularly effective to low the FATT.

The martensite steel in this embodiment, which is significantly high in creep rupture strength at a high temperature near 600° C., sufficiently satisfies the strength required for a rotor shaft for ultra-high/high pressure steam turbine, and therefore, it is suitable for such a rotor shaft; and also it is suitable for a blade for a high efficient turbine operated at a temperature near 600° C.

Embodiment 5

Table 13 shows chemical compositions (wt %) of inner casings for a high pressure turbine, an intermediate pressure turbine, and a high pressure/intermediate pressure turbine of the present invention. A sample having a size determined in consideration of a thick wall portion of a large size casing was produced by melting 200 kg of a material shown in Table 13 in a high frequency induction melting furnace, and cast in a sand mold having a maximum thickness of 200 mm, a width of 380 mm, and a height of 440 mm, to prepare an ingot. The sample thus obtained was subjected to annealing (1050° C.×8 h→furnace cooling), and then subjected to heat-treatments suitable for a thick wall portion of a large-sized steam turbine casing, that is, normalizing (1050° C.×8 h→air cooling) and temper (twice, 710° C.×7 h→air cooling+710° C.×7 h→air cooling).

The weldability of the sample was evaluated in accordance with JIS Z3158. Each of the pre-heating temperature, interpass temperature, and post-heating temperature stating temperature was set at 150° C., and the post-heating treatment was performed in a condition of 400° C.×30 min.

TABLE 13

| Sample No. | C | Si | Mn | Ni | Cr | Mo | W | V | Nb | N | W | Cr equivalent | Ni/W |
|---|---|---|---|---|---|---|---|---|---|---|---|---|---|
| 1 | 0.12 | 0.22 | 0.51 | 0.80 | 9.05 | 0.59 | 1.59 | 0.21 | 0.06 | 0.05 | 0.0031 | 7.13 | 0.52 |
| 2 | 0.13 | 0.20 | 0.50 | 0.61 | 8.97 | 0.11 | 1.60 | 0.19 | 0.07 | 0.05 | 0.0019 | 5.31 | 0.38 |
| 3 | 0.12 | 0.20 | 0.48 | 0.61 | 9.00 | 0.62 | 1.66 | 0.19 | 0.07 | 0.03 | 0.0010 | 8.21 | 0.37 |

Table 14 shows results of examining the tensile characteristic at room temperature, Charpy V-notch impact absorption energy at 20° C., 103 h creep rupture strength, and welding crack for each sample shown in Table 13.

The creep rupture strength and impact absorption energy of the inventive material containing B, Mo and W in suitable amounts sufficiently satisfy characteristics ($10^5$ h creep rupture strength (at 625° C.)≧8 kgf/mm$^2$, impact absorption energy (at 20° C.)≧1 kgf-m) required for a high temperature/high pressure turbine casing. In particular, the inventive material exhibits a high $10^5$ h creep rupture strength (at 625° C.) of 9 kgf/mm$^2$ or more. In the inventive material there occurs no welding crack. This means that the inventive material is good in weldability. As a result of examining a relationship between the B content and welding crack, there occurred welding crack for the alloy containing B in an amount more than 0.0035 wt %. In this regard, Sample No. 1 has a possibility that there occurs slightly welding crack. As a result of examining an effect of the Mo content on the mechanical properties, the alloy containing Mo in an amount being as large as 1.18% exhibited a high creep rupture strength but an impact value lower than the required value. Meanwhile, the alloy containing Mo in an amount of 0.11 wt % exhibited a high toughness but a creep rupture strength lower than the required value.

As a result of examining an effect of the W content on mechanical properties, the alloy containing W in an amount of 1.1 wt % exhibited a very high creep rupture strength, but the alloy containing W in an amount of 2 wt % or more exhibited a low impact absorption energy at room temperature. In particularly, by adjusting a Ni/W ratio to be in a range of 0.25 to 0.75, there can be obtained a heat resisting cast steel casing material satisfying characteristics required for high pressure and intermediate pressure inner casings, main steam stop valve casing, and steam governor valve casing of a high temperature/high pressure turbine used at a temperature of 621° C. or more and at a pressure of 250 kgf/cm$^2$ or more, that is, exhibiting a 10h creep rupture strength (at 625° C.) of 9 kgf/mm$^2$ or more and an impact absorption energy (at room temperature) of 1 kgf-m or more. In particular, by adjusting the W content to be in a range of 1.2 to 2 wt % and the Ni/W ratio to be in a range of 0.25 to 0.75, there can be obtained a good heat resisting cast steel casing material exhibiting a $10^5$ h creep rupture strength (at 625° C.) of 10 kgf/mm$^2$ or more and an impact absorption energy (at room temperature) of 2 kgf-m or more.

TABLE 14

| Sample No. | Tensile strength (kgf/mm$^2$) | Elongation (%) | Reduction of area (%) | Impact absorption energy (kgf-m) | 625° C., $10^5$ h creep rapture strength (Kgf/mm$^2$) | Weld cracking |
|---|---|---|---|---|---|---|
| 1 | 72.8 | 19.7 | 64.8 | 2.1 | 9.7 | Presence |
| 2 | 71.6 | 19.9 | 65.8 | 2.1 | 8.5 | Absence |
| 3 | 72.5 | 20.2 | 64.8 | 2.4 | 10 | Absence |

The W content in a range of 1.0 wt % or more is significantly effective to increase the strength of the alloy. In particular, the alloy containing W in an amount of 1.5 wt % or more exhibits a strength of 8.0 kgf/mm$^2$ or more. Sample No. 7 was proved to sufficiently satisfy the required strength at a temperature of 640° C. or less.

The inner casing of the high pressure/intermediate pressure portion described in Embodiment 3 was produced by melting 1 ton of an alloy material having a specific composition of the heat resisting steel of the present invention in an electric furnace, followed by ladle refining, and casting it in a sand mold. The casing thus obtained was subjected to annealing (1050° C.×8 h→furnace cooling), and then subjected to normalizing (1050° C.×8 h→air blast cooling) and temper (twice, 730° C.×8 h→furnace cooling+730° C.×8 h→furnace cooling). The trial casing having a full temper martensite structure was cut and examined in terms of mechanical properties. As a result, it was confirmed that the casing sufficiently satisfies characteristics ($10^5$ h creep rupture strength (at 625° C.)≧9 kgf/mm$^2$; impact absorption energy (at 20° C.)≧1 kgf-m) required for a high temperature/high pressure turbine casing used at 250 atm and 625° C. and it is also weldable.

Embodiment 6

In this embodiment, the steam temperature in a high pressure steam turbine and an intermediate pressure steam turbine or a high pressure/intermediate pressure steam turbine is changed from 625° C. to 649° C., and the structure and size of each steam turbine are designed to be substantially the same as those in Embodiment 2 or 3. This embodiment is different from Embodiment 2 in terms of the rotor shaft, first stage rotating blade, first stage stationary blade and inner casing, directly exposed to the above temperature atmosphere, of each of the high pressure steam turbine and the intermediate pressure steam turbine or the high pressure/intermediate steam turbine. As the material for the rotor shaft, first stage rotating blade and stationary blade, there is used such a material that the contents of B and Co in each material shown in Table 7 are increased to a value of 0.01 to 0.03 wt % and a value of 5 to 7 wt %, respectively. As the material for the inner casing, there is used such a material in which the content of W in each material in Embodiment 2 is increased to a value of 2 to 3 wt % and further Co is added to the material in an amount of 3 wt %. Each of the rotor shaft, first stage rotating blade, stationary blade and inner casing made from the above materials satisfy the required strengths. This exhibits a large merit that the conventional design can be used as it is. That is to say, in this embodiment, by making all structural members exposed to high temperatures from ferrite based steels, the conventional design thought can be adopted as it is. In addition, since the steam inlet temperatures of the second stage rotating blade and stationary blade are about 610° C., they are preferably made from the materials used for the first stage rotating blade and stationary blade in Embodiment 1, respectively.

The steam temperature of the low pressure steam turbine is about 405° C., which is slightly higher than the steam temperature (about 380° C.) of the low pressure steam turbine in Embodiment 2 or 3, but the material used for the rotor shaft in Embodiment 2 has the sufficiently high strength, and accordingly, the same super clean material is used in this embodiment.

The configuration of the cross compound type in this embodiment can be applied to a tandem type having the number of revolution of 3600 rpm in which all of the steam turbines are directly connected to each other.

Industrial Applicability

According to the present invention since a martensite based heat resisting cast steel having a high creep rupture strength at a temperature of 600 to 660° C. and a high toughness at room temperature can be obtained, main members for an ultrasuper critical pressure turbine at each temperature can be all made from ferrite based heat resisting steels, and consequently, there can be obtained a thermal power-generation plant with a high reliability using the conventional basic design for the steam turbine as it is.

Conventionally, the member used at such a temperature has been required to be made from an austenite based alloy, and thereby a large-sized rotor having a high quality has failed to be produced in terms of production ability; however, a large-sized rotor having a high quality can be produced using a ferrite based heat resisting forged steel of the present invention.

The high temperature steam turbine made from full ferrite based steels according to the present invention is advantageous in that the turbine is easy to rapidly star- and is less susceptible to damages due to thermal fatigue because it does not use an austenite based alloy having a large thermal expansion coefficient.

What is claimed is:

1. A method of producing a steam turbine blade, characterized by melting a martensite steel material containing 0.08 to 0.18 wt % of C, 0.25 wt % or less of Si, 0.90 wt % or less of Mn, 8.0 to 13.0 wt % of Cr, 2 to 3 wt % or less of Ni, 1.5 to 3.0 wt % of Mo, 0.05 to 0.35 wt % of V, 0.02 to 0.20 rwt % in total of one kind or two kinds of Nb and Ta, and 0.02 to 0.10 wt % of N to prepare an ingot, and forging the ingot;

quenching the ingot by heating and keeping the ingot to and at a temperature of 1000 to 1100° C. and rapidly cooling it; and primarily tempering the ingot by heating and keeping the ingot to and at a temperature of 550 to 570° C. and cooling it, and secondarily tempering the ingot by heating and keeping the ingot to and at a temperature of 560 to 590° C. and cooling it.

* * * * *